US008818216B2

(12) United States Patent
Hirai

(10) Patent No.: US 8,818,216 B2
(45) Date of Patent: Aug. 26, 2014

(54) IMAGE FORMING APPARATUS, IMAGE FORMING METHOD, AND COMPUTER PROGRAM PRODUCT

(75) Inventor: Shuji Hirai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 319 days.

(21) Appl. No.: 12/876,707

(22) Filed: Sep. 7, 2010

(65) Prior Publication Data

US 2011/0058823 A1 Mar. 10, 2011

(30) Foreign Application Priority Data

Sep. 9, 2009 (JP) ..... 2009-208738

(51) Int. Cl.
*G03G 15/00* (2006.01)
*G03G 15/01* (2006.01)

(52) U.S. Cl.
CPC .. *G03G 15/0131* (2013.01); *G03G 2215/00059* (2013.01); *G03G 15/5058* (2013.01); *G03G 2215/0129* (2013.01)
USPC ..... 399/49; 399/223; 399/301

(58) Field of Classification Search
USPC ..... 399/24–30, 33, 46, 49, 223, 297, 399/299–302, 320
See application file for complete search history.

(56) References Cited

U.S. PATENT DOCUMENTS

| | | | | |
|---|---|---|---|---|
| 6,975,338 | B2 | 12/2005 | Hirai et al. | |
| 7,151,901 | B2 | 12/2006 | Hirai | |
| 7,193,642 | B2 | 3/2007 | Hirai et al. | |
| 7,343,126 | B2 | 3/2008 | Miyawaki et al. | |
| 7,359,660 | B2 | 4/2008 | Nakazato et al. | |
| 7,693,466 | B2 | 4/2010 | Miyawaki et al. | |
| 2005/0260004 | A1 * | 11/2005 | Maebashi et al. | 399/15 |
| 2007/0258723 | A1 | 11/2007 | Nakazato et al. | |
| 2008/0075476 | A1 | 3/2008 | Nakazato et al. | |
| 2008/0205923 | A1 | 8/2008 | Takeuchi et al. | |
| 2008/0253793 | A1 | 10/2008 | Ishibashi et al. | |
| 2008/0292360 | A1 | 11/2008 | Hirai | |

(Continued)

FOREIGN PATENT DOCUMENTS

| | | |
|---|---|---|
| JP | 2003-149883 | 5/2003 |
| JP | 3542582 | 4/2004 |
| JP | 2005-321572 | 11/2005 |

OTHER PUBLICATIONS

Japanese Office Action dated May 24, 2013, in Japanese Application No. 2009-208738.

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

A toner-image detecting sensor for detecting a toner image before being transferred onto a recording sheet and a fixed-image detecting sensor for detecting the toner image after being secondarily transferred and fixed on the recording sheet are arranged so that the positions of them in a main scanning corresponding direction are aligned. An image forming apparatus has a first image adjustment mode and a second image adjustment mode. In the first image adjustment mode, image adjustment is made on the basis of only a result of detection by the toner-image detecting sensor without transferring the test pattern onto the recording sheet. In the second image adjustment mode, the test pattern is transferred onto the recording sheet, and image adjustment is made on the basis of both a result of detection by the toner-image detecting sensor and a result of detection by the fixed-image detecting sensor.

18 Claims, 15 Drawing Sheets

(56) References Cited

U.S. PATENT DOCUMENTS

2009/0110413 A1 4/2009 Takeuchi et al.
2009/0208233 A1* 8/2009 Hirai ..... 399/60
2009/0324267 A1 12/2009 Yoshida et al.
2010/0033743 A1 2/2010 Hirai
2010/0111547 A1 5/2010 Kawamoto et al.

* cited by examiner (1-LIGHT EMISSION AND 2-LIGHT RECEPTION)

(2-LIGHT EMISSION AND 1-LIGHT RECEPTION)

(WHEN TWO SENSORS DETECT
THE SAME OBJECT)

(WHEN TWO SENSORS DETECT
DIFFERENT OBJECT)

(WHEN TWO SENSORS DETECT THE SAME OBJECT)

(WHEN TWO SENSORS DETECT THE DIFFERENT OBJECT)

(MEASUREMENT DATA OF TONER-IMAGE DETECTING SENSOR)

(MEASUREMENT DATA OF FIXED-IMAGE DETECTING SENSOR)

(CASE 2 WHERE IT DEVIATES FROM NORMAL STATE)

(CASE WHERE THERE IS ABNORMAL POINT)

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese Patent Application No. 2009-208738 filed in Japan on Sep. 9, 2009.

BACKGROUND OF THE INVENTION

1. Field of the Invention

The present invention relates to an image forming apparatus, such as a printer, a copier, and a facsimile machine, an image forming method, and a computer program product.

2. Description of the Related Art

An image forming apparatus, such as a copier and a laser beam printer, using an electrophotographic system performs the following image adjustment operation to obtain a stable image. That is, the electrophotographic image forming apparatus forms a test pattern on an image carrier such as a photosensitive element, and detects the test pattern on the image carrier with an optical sensor which is an optical detecting unit, and then adjusts image forming conditions, such as a charge potential, a developing bias, and an exposure amount, on the basis of a result of the detection.

There is a problem in the above-mentioned image adjustment operation, that is, the electrophotographic image forming apparatus can neither detect a defect in an image forming process (a process of transferring an image onto a transfer sheet and a process of fixing the image on the transfer sheet) performed on the downstream side of where the optical sensor is placed nor adjust the defect.

Japanese Patent Application Laid-open No. 2005-321572 discloses an image forming apparatus that includes a density sensor which is a toner-image detecting unit for detecting an unfixed toner image on an image carrier (including an intermediate transfer belt) and a color sensor which is a fixed-image detecting unit for detecting a fixed toner image fixed on a recording sheet, and detects a defect in an image forming process (a process of transferring a toner image onto a transfer sheet and a process of fixing the toner image on the transfer sheet) performed on the downstream side of where the density sensor is placed on the basis of results of detection by the density sensor and the color sensor. Specifically, first, the image forming apparatus forms an image adjustment pattern composed of a yellow gradation patch, a magenta gradation patch, a cyan gradation patch, and a black gradation patch under predetermined image forming conditions, and detects the image adjustment pattern with the density sensor. Then, the image forming apparatus forms another image adjustment pattern composed of the same gradation patches under the same image forming conditions, and detects this image adjustment pattern with the color sensor. Incidentally, the width of the image adjustment pattern detected by the color sensor is larger than that of the image adjustment pattern detected by the density sensor. It is considered that this is because of the following reason. The sensor for detecting a fixed image detects an image formed on a transfer sheet but does not differentiate between a diffusely-reflected light reflected from the surface of the transfer sheet and a diffusely-reflected light reflected from the image, so a general reflective optical sensor for detecting a toner adhering amount cannot be used as the sensor for detecting a fixed image. Consequently, as the sensor for detecting a fixed image, a color sensor including a white LED and a charge accumulation type sensor with an RGB on-chip filter is used. In such a color sensor, if a detection area is broadened, an amount of light input to the charge accumulation type sensor increases, and the detection sensitivity increases. Consequently, the detection area of the color sensor is broadened, therefore, it is considered that the width of the image adjustment pattern detected by the color sensor needs to be extended. On the other hand, as the density sensor for detecting a toner image on the image carrier, a general reflective optical sensor that receives a specularly-reflected light and a diffusely-reflected light which are reflected from the detection surface can be used because the surface of the image carrier is smooth. Then, a specularly-reflected light and a diffusely-reflected light which are reflected from the image adjustment pattern on the image carrier are detected, and a toner adhering amount of each of the patches is detected from a combination of the specularly-reflected light and the diffusely-reflected light. In such a reflective optical sensor, if a detection area is broadened, the sensitivity to a specularly-reflected light decreases; therefore, it is necessary to detect reflected lights with the detection area narrowed down. Consequently, there is no need to extend the width of each of the patches of the image adjustment pattern detected by the density sensor, therefore, it is considered that the width of the image adjustment pattern detected by the density sensor is smaller than that of the image adjustment pattern detected by the color sensor.

Then, the image forming apparatus checks whether a relation between the detection result of the density sensor and the detection result of the color sensor has a predetermined relation. If there is no defect in the transfer process and the fixing process, the relation between the detection result of the density sensor and the detection result of the color sensor is a predetermined relation; however, if there is any defect in the above processes, the relation is not a predetermined relation. Therefore, by checking a relation between detection result of the density sensor and a detection result of the color sensor, the image forming apparatus can detect a defect in the transfer process and the fixing process, and can adjust a transfer parameter and a fixing parameter on the basis of the detected defect in the transfer process and the fixing process. Furthermore, on the basis of the detected defect in the transfer process, the image forming apparatus adjusts an amount of toner adhered by adjusting a development parameter and a charging parameter, whereby it is possible to correct degradation of the image quality due to the defect in the transfer process.

However, in the image forming apparatus disclosed in Japanese Patent Application Laid-open No. 2005-321572, the main-scanning-direction position where the density sensor detects is different from the main-scanning-direction position where the color sensor detects. Therefore, the main-scanning-direction position where the image adjustment pattern detected by the density sensor is formed is different from the main-scanning-direction position where the image adjustment pattern detected by the color sensor is formed. As a result, the effect of main-scanning-direction uneven density of the detection result of the density sensor is different from the effect of main-scanning-direction uneven density of the detection result of the color sensor. Therefore, a relation between the detection result of the density sensor and the detection result of the color sensor is greatly affected by the effects of the main-scanning-direction uneven density, so the image forming apparatus cannot accurately detect a defect in the transfer process and fixing process.

To cope with this problem, in Japanese Patent Application No. 2009-39554, the present applicant has proposed an image forming apparatus in which a toner-image detecting unit and a fixed-image detecting unit are placed so that the main-scanning-direction positions of them are aligned. Consequently, the effect of main-scanning-direction uneven density of a detection result of the toner-image detecting unit and the effect of main-scanning-direction uneven density of a detection result of the fixed-image detecting unit can be about the same. Therefore, it is possible to prevent a relationship between the detection result of the toner-image detecting unit and the detection result of the fixed-image detecting unit from being affected by the effects of the main-scanning-direction uneven density. As a result, on the basis of the detection result of the toner-image detecting unit and the detection result of the fixed-image detecting unit, the image forming apparatus can accurately detect a state of an image forming process performed on the downstream side of the detection position of the toner-image detecting unit in a toner-image moving direction, and can perform highly-accurate image adjustment.

However, the image forming apparatus disclosed in Japanese Patent Application No. 2009-39554 performs only the image adjustment control using a detection result of the toner-image detecting unit and a detection result of the fixed-image detecting unit. Such image adjustment control using the detection result of the fixed-image detecting unit has the drawback of consuming a transfer sheet which is a user's belonging. If the execution interval of the image adjustment control is extended, it is possible to curb the consumption of transfer sheets due to the image adjustment control; however, a problem with the image quality may arise because the image adjustment control is not performed for a long time.

SUMMARY OF THE INVENTION

It is an object of the present invention to at least partially solve the problems in the conventional technology.

According to an aspect of the present invention, there is provided an image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the image forming apparatus including a toner-image detecting unit that detects the toner image on the image carrier; a fixed-image detecting unit that detects the toner image fixed on the recording medium; a first image adjusting unit that forms an image adjustment test pattern on the image carrier, causes the toner-image detecting unit to detect the image adjustment test pattern on the image carrier, controls the image adjustment test pattern on the image carrier not to be transferred onto the recording medium, and adjusts an image forming condition on the basis of a detection value of the image adjustment test pattern detected by the toner-image detecting unit; and a second image adjusting unit that forms an image adjustment test pattern on the image carrier, and after the toner-image detecting unit detects the image adjustment test pattern on the image carrier, transfers and fixes the image adjustment test pattern on a recording medium, or again forms an image adjustment test pattern on the image carrier and transfers and fixes the image adjustment test pattern formed on the image carrier on a recording medium, causes the fixed-image detecting unit to detect the image adjustment test pattern fixed on the recording medium, and adjusts an image forming condition on the basis of a detection value of the image adjustment test pattern detected by the toner-image detecting unit and a detection value of the image adjustment test pattern detected by the fixed-image detecting unit, wherein the toner-image detecting unit and the fixed-image detecting unit are arranged so that positions of them in a main scanning direction perpendicular to a conveying direction of the recording medium are aligned.

According to another aspect of the present invention, there is provided an image forming method in an image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the image forming method including detecting the toner image on the image carrier by a toner-image detecting unit; detecting the toner image fixed on the recording medium by a fixed-image detecting unit; forming an image adjustment test pattern on the image carrier, causing the toner-image detecting unit to detect the image adjustment test pattern on the image carrier, controlling the image adjustment test pattern on the image carrier not to be transferred onto the recording medium, and adjusting an image forming condition on the basis of a detection value of the image adjustment test pattern detected by the toner-image detecting unit, by a first image adjusting unit; and forming an image adjustment test pattern on the image carrier, and after the toner-image detecting unit detecting the image adjustment test pattern on the image carrier, transferring and fixing the image adjustment test pattern on a recording medium, or again forming an image adjustment test pattern on the image carrier and transferring and fixing the image adjustment test pattern formed on the image carrier on a recording medium, causing the fixed-image detecting unit to detect the image adjustment test pattern fixed on the recording medium, and adjusting an image forming condition on the basis of a detection value of the image adjustment test pattern detected by the toner-image detecting unit and a detection value of the image adjustment test pattern detected by the fixed-image detecting unit, by a second image adjusting unit, wherein the toner-image detecting unit and the fixed-image detecting unit are arranged so that positions of them in a main scanning direction perpendicular to a conveying direction of the recording medium are aligned.

According to still another aspect of the present invention, there is provided a computer program product comprising a computer-usable medium having computer-readable program codes embodied in the medium for forming image in an image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the program codes when executed causing a computer to execute: detecting the toner image on the image carrier by a toner-image detecting unit; detecting the toner image fixed on the recording medium by a fixed-image detecting unit; forming an image adjustment test pattern on the image carrier, causing the toner-image detecting unit to detect the image adjustment test pattern on the image carrier, controlling the image adjustment test pattern on the image carrier not to be transferred onto the recording medium, and adjusting an image forming condition on the basis of a detection value of the image adjustment test pattern detected by the toner-image detecting unit, by a first image adjusting unit; and forming an image adjustment test pattern on the image carrier, and after the toner-image detecting unit detecting the image adjustment test pattern on the image carrier, transferring and fixing the image adjustment test pattern on a recording medium, or again forming an image adjustment test pattern on the image carrier and transferring and fixing the image adjustment test pattern formed on the image carrier on a recording medium, causing the fixed-image detecting unit to detect the image adjustment test pattern fixed on the recording medium, and adjusting an image forming condition on the basis of a detection value of the image adjustment test pattern detected by the toner-image detecting unit and a detection value of the image adjustment test pattern detected by the fixed-image detecting unit, by a second image adjusting unit, wherein the toner-image detecting unit and the fixed-image detecting unit are arranged so that positions of them in a main scanning direction perpendicular to a conveying direction of the recording medium are aligned.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of the present invention is explained below with reference to the accompanying drawings.

Figure 1:
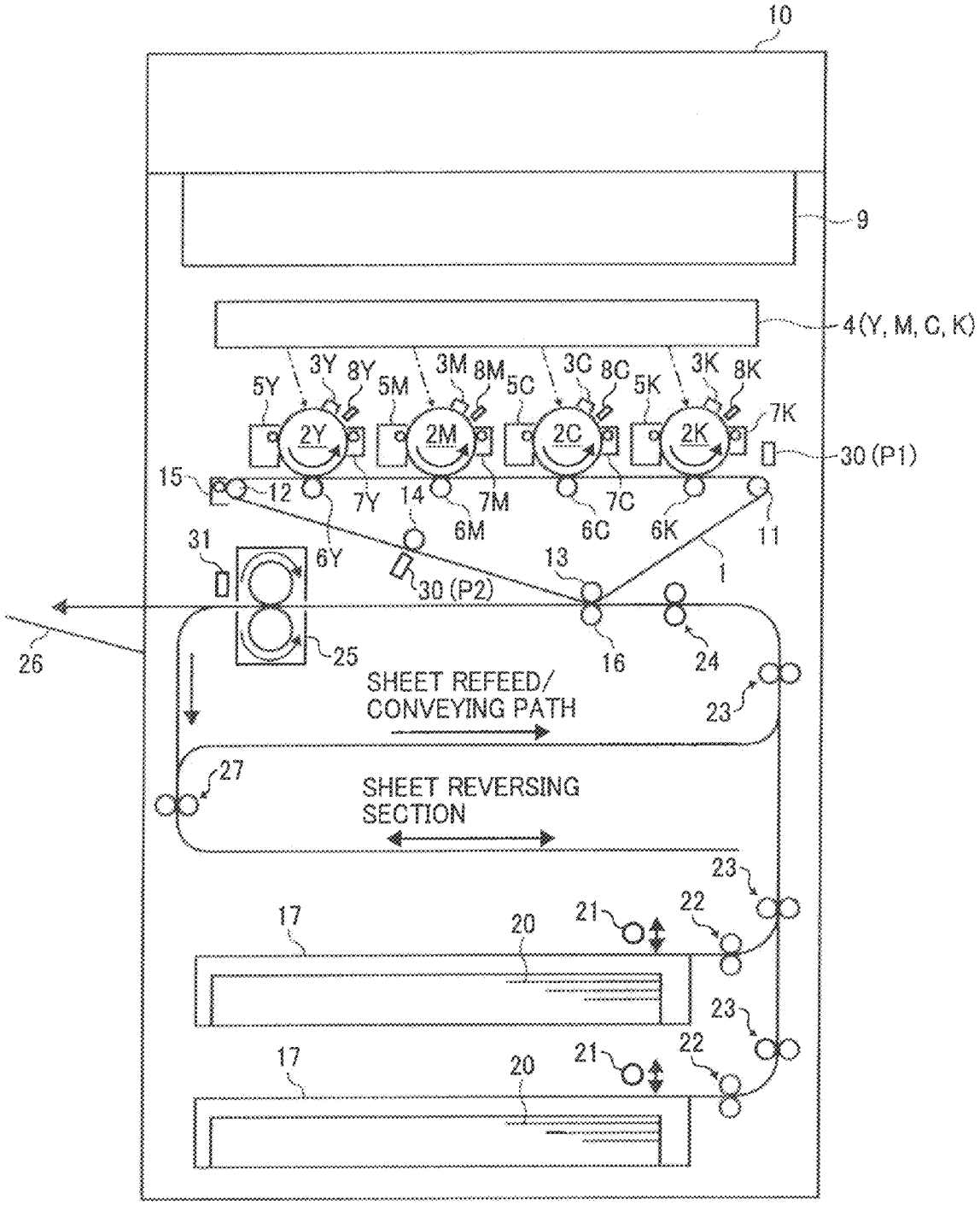
FIG. 1 is a schematic configuration diagram of an image forming apparatus according to an embodiment of the present invention.

FIG. 1 is a schematic diagram of an image forming apparatus according to the present embodiment. The image forming apparatus shown in FIG. 1 is depicted as a full-color image forming apparatus of a four-tandem-type intermediate transfer system as a system; however, it is just a typical example of an electrophotographic image forming apparatus. Alternatively, the image forming apparatus can be a full-color image forming apparatus of a four-tandem-type direct transfer system, a one-drum-type intermediate transfer system, or the like and a black-and-white image forming apparatus of a one-drum-type direct transfer system or the like.

Photosensitive drums 2Y, 2M, 2C, and 2K, which are image carriers, are arranged to be aligned along the expanded surface of an intermediate transfer belt 1, which is an image carrier and an intermediate transfer body. Alphabetic codes "Y", "M", "C", and "K" attached to the reference numerals indicate yellow, magenta, cyan, and black colors, respectively. A yellow image forming station is explained as a representative. A electric charger 3Y as a charging unit, a writing unit 4Y, a developing unit 5Y, a primary transfer roller 6Y as a primary transfer unit, a photosensitive element cleaning unit 7Y, and a quenching lamp 8Y are arranged around the photosensitive drum 2Y in order of a rotating direction of the photosensitive drum 2Y. The same holds true for the other image forming stations for magenta, cyan, and black colors.

A scanner unit 9, an automatic document feeder (ADF) 10, and the like are provided above the writing unit 4.

The intermediate transfer belt 1 is rotatably supported by a plurality of rollers 11, 12, and 13. An intermediate-transfer-belt cleaning unit 15 as a cleaning unit is provided at a site opposed to the roller 12.

A secondary transfer roller 16 as a transfer unit is provided at a site opposed to the roller 13.

A plurality of sheet trays 17 are provided in the lower part of a main body of the apparatus, and each contain therein recording sheets 20 as recording media. A recording sheet 20 is fed from the sheet tray 17 by a pick-up roller 21 and a sheet feed roller 22, and conveyed by a pair of conveying rollers 23, and then delivered to a secondary transfer site at a predetermined timing by a pair of registration rollers 24. A fixing unit 25 as a fixing means is provided on the downstream side of the secondary transfer site in a sheet conveying direction. In FIG. 1, a reference numeral 26 denotes a copy receiving tray, and a reference numeral 27 denotes a pair of switchback rollers.

The whole image forming operation in the configuration shown in FIG. 1 is explained. When a print start instruction is input, the rollers around the photosensitive drums, around the intermediate transfer belt, on a sheet conveying path, and the like each start rotating at a predetermined timing, and the feeding of a recording sheet from the sheet tray in the lower part is started.

On the other hand, the surface of each photosensitive drum 2 is charged to have a uniform electrical potential by the electric charger 3, and exposed to a writing light emitted from the writing unit 4 in accordance with image data. A potential pattern after the exposure is called an electrostatic latent image. The photosensitive drum 2 carrying the electrostatic latent image on the surface thereof is supplied with toner from the developing unit 5, whereby the electrostatic latent image is developed into a specific color image.

In FIG. 1, there are the photosensitive drums 2 for four colors—yellow, magenta, cyan, and black colors, so yellow, magenta, cyan, and black (the order of colors vary from system to system) toner images are formed on the respective photosensitive drums 2.

At a contact point with the intermediate transfer belt 1, each of the toner images formed on the photosensitive drums 2 is transferred onto the intermediate transfer belt 1 by a primary transfer bias applied to the primary transfer roller 6 placed to be opposed to the photosensitive drum and a pressing force. Such primary transfer operations for the four colors are sequentially performed in a timely manner, whereby a full-color toner image is formed on the intermediate transfer belt 1.

In a secondary transfer roller section, the full-color toner image formed on the intermediate transfer belt 1 is transferred onto the recording sheet 20 timely conveyed by the pair of registration rollers 24. At this time, the secondary transfer is made by a secondary transfer bias applied to the secondary transfer roller 16 and a pressing force. The recording sheet 20 onto which the full-color toner image is transferred passes through the fixing unit 25, whereby the toner image carried on the surface of the recording sheet 20 is heated and fixed on the recording sheet 20.

In the case of one-side printing, the recording sheet 20 is conveyed straight and discharged onto the copy receiving tray 26. In the case of two-side printing, the conveying direction of the recording sheet 20 is switched to a downward direction, and the recording sheet 20 is conveyed to a sheet reversing section. When the recording sheet 20 has reached the sheet reversing section, the conveying direction of the recording sheet 20 is reversed by the pair of switchback rollers 27, and the recording sheet 20 goes out of the sheet reversing section from the rear end of the sheet. This is called a switchback operation, and a recording sheet can be turned upside down by this operation.

The recording sheet turned upside down does not go back to a direction of the fixing unit but passes through a sheet refeed/conveying path and merges into an original sheet feed path. After that, in the same manner as in the front side printing, a toner image is transferred onto the back side of the recording sheet, and the recording sheet passes through the fixing unit 25 and then discharged. This is the two-side printing operation. The operations of the respective units are explained to the end. The photosensitive drum 2 passing through the primary transfer section carries primary transfer residual toner on the surface thereof, and the photosensitive element cleaning unit 7 composed of a blade, a brush, and the like removes the primary transfer residual toner from the surface of the photosensitive drum 2. After that, static electricity on the surface of the photosensitive drum 2 is uniformly eliminated by the quenching lamp 8 so that the photosensitive drum 2 can be ready for the charging for a next image.

Furthermore, as for the intermediate transfer belt 1 passing through the secondary transfer section, the intermediate transfer belt 1 carries secondary transfer residual toner on the surface thereof, and the intermediate-transfer-belt cleaning unit 15 composed of a blade, a brush, and the like removes the secondary transfer residual toner from the surface of the intermediate transfer belt 1 so that the intermediate transfer belt 1 can be ready for the transfer of a next toner image. The one-side printing or two-side printing is performed by the repetition of such an operation.

A toner-image detecting sensor 30 as a toner-image detecting unit is arranged at the position opposed to the roller 11 (the position before the secondary transfer is performed) on the outside of the intermediate transfer belt 1. Alternatively, the toner-image detecting sensor 30 can be arranged on the downstream side of the secondary transfer section (at the position after the secondary transfer is performed). If the toner-image detecting sensor 30 is arranged on the downstream side of the secondary transfer section, a roller 14 for anti-vibration is provided on the inside of the intermediate transfer belt 1.

A fixed-image detecting sensor 31 as a fixed-image detecting unit is arranged near the downstream side of the fixing unit 25.

The fixed-image detecting sensor 31 is literally arranged just behind the fixing unit 25, i.e., at the position just after the toner image transferred onto the recording sheet in the secondary transfer process is fixed on the recording sheet in the fixing unit 25. The fixed-image detecting sensor 31 can detect all the four-color toner images fixed on the recording sheet.

The fixed-image detecting sensor 31 can be placed at the position either before or after the branching into the sheet reversing section, so the placement position of the fixed-image detecting sensor 31 is determined depending on a destination where a recording sheet on which a test pattern has been formed is conveyed. If the recording sheet on which the test pattern has been formed is directly discharged onto the copy receiving tray 26, the fixed-image detecting sensor 31 can be placed at the position either before or after the branching into the sheet reversing section. On the other hand, if the recording sheet on which the test pattern has been formed is conveyed to somewhere in the image forming apparatus (typically, a special built-in tray for a test-pattern recording sheet), the fixed-image detecting sensor 31 has to be placed at the position before the branching.

Furthermore, as the placement position of the toner-image detecting sensor 30, there are two possible positions as above. One of the placement positions is a position 21 before the secondary transfer is performed. The position 21 is where the toner-image detecting sensor 30 can detect a toner pattern on the intermediate transfer belt 1 before being subjected to the secondary transfer process; if there is no restriction in machine layout, this configuration is mostly employed. As the toner-image detecting sensor 30 can detect the toner pattern soon after the toner pattern has been formed, a shorter latency time is required, and also there is no need to cause the toner pattern to pass through the secondary transfer section, so it is not necessary to design for it.

However, there are many models of image forming apparatuses in which the secondary transfer position is set just behind the image forming station for the fourth color (black, in this case); in this case, it is difficult to install the sensor at the position P1 because of space limitations. In such a case, the toner-image detecting sensor 30 is placed at a position P2 which is the position after the secondary transfer is performed, and the toner-image detecting sensor 30 detects the toner pattern formed on the intermediate transfer belt 1 after the toner pattern has passed through the secondary transfer section.

As a method for causing the toner pattern to pass through the secondary transfer section, separation of the secondary transfer roller 16, the application of a reverse bias to the secondary transfer roller 16, and the like can be considered; however, the method is not limited here. In the case of the image forming apparatus of the four-tandem-type intermediate transfer system, any of the above two positions can be employed as the position of the toner-image detecting sensor 30.

In the image forming apparatus shown in FIG. 1, the photosensitive drum 2, the electric charger 3, the writing unit 4Y, the developing unit 5Y, and the primary transfer roller 6Y serve as an image forming unit.

Figure 2:
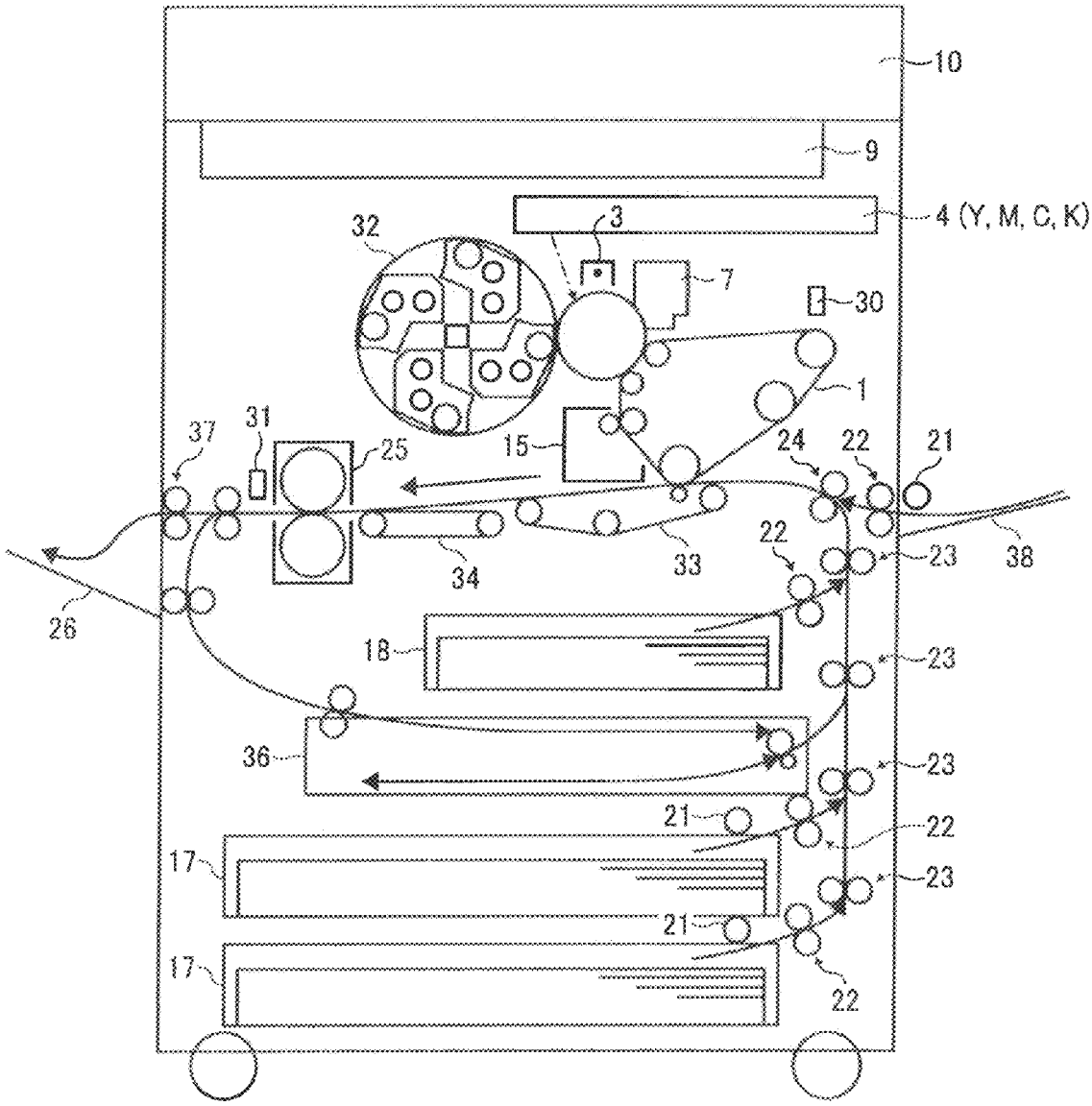
FIG. 2 is a schematic configuration diagram of another example of the (one-drum-type) image forming apparatus.
Figure 3:
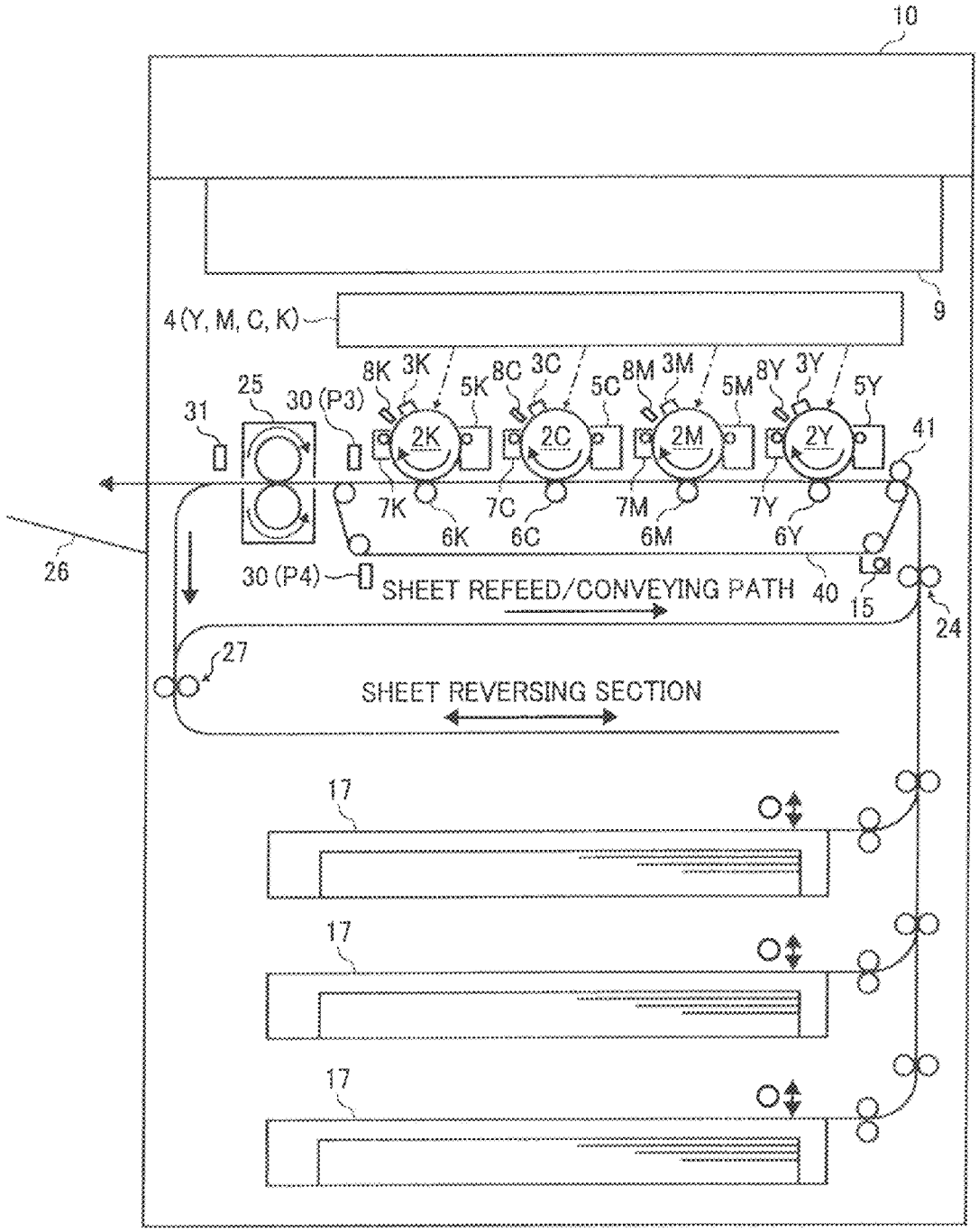
FIG. 3 is a schematic configuration diagram of still another example of the image forming apparatus (of a direct transfer system)

FIGS. 2 and 3 show examples of placements of the toner-image detecting sensor and the fixed-image detecting sensor in the case of an image forming apparatus of another system. FIG. 2 shows an example of placements of the sensors in the case of a full-color image forming apparatus of a one-drum-type intermediate transfer system.

The image forming apparatus of the one-drum-type intermediate transfer system differs from the image forming apparatus of the four-tandem-type intermediate transfer system shown in FIG. 1 only in the configuration of the image forming station section (the photosensitive element unit, the developing unit, and the like); however, as for the units on the downstream side of the intermediate transfer unit, the image forming apparatus of the one-drum-type intermediate transfer system has basically the same configuration as the image forming apparatus of the four-tandem-type intermediate transfer system shown in FIG. 1.

In FIG. 2, a reference numeral 18 denotes a sheet tray, a reference numeral 32 denotes a revolver-type developing unit, a reference numeral 33 denotes a secondary transfer unit of a belt transfer system, a reference numeral 34 denotes a belt conveying unit, a reference numeral 36 denotes a duplex unit, a reference numeral 37 denotes a pair of sheet discharge rollers, and a reference numeral 38 denotes a manual sheet tray. Components having the same functions as those shown in FIG. 1 are denoted by the same reference numerals.

The image forming apparatus includes only one set of photosensitive element unit including the photosensitive drum 2, so there is enough space around the intermediate transfer unit including the intermediate transfer belt 1, i.e., the image forming apparatus has a configuration that the toner-image detecting sensor 30 can be placed on the upstream side of the secondary transfer process relatively easily.

If there is not enough space, of course, the toner-image detecting sensor 30 can be placed on the downstream side of the secondary transfer process in the same manner as shown in FIG. 1; however, it is not illustrated here.

FIG. 3 shows an example of placements of the sensors in the case of a full-color image forming apparatus of a four-tandem-type direct transfer system. In this system, a belt opposed to the photosensitive drums 2 is not an intermediate transfer belt but a transfer conveyance belt 40. The transfer conveyance belt 40 holds and conveys a recording sheet, and YMCK toner images are sequentially transferred onto the recording sheet on the transfer conveyance belt 40 directly. Materials of the belt include, but are not particularly limited to, polyimide and the like in the same manner as the intermediate transfer belt. As a method for holding a recording sheet, in general, the recording sheet is electrostatically attracted onto the belt and conveyed in accordance with the movement of the belt; in this case, a bias voltage can be applied to a roller 41 placed at the position just after touchdown of the recording sheet is made so that electrical charge can be applied to the recording sheet.

In such a transfer conveyance belt system, a method of transferring a test pattern on each photosensitive drum onto the transfer conveyance belt 40 and detecting the test pattern on the transfer conveyance belt 40 is often used; in this case, the toner-image detecting sensor 30 is placed at a position P3 or a position P4.

Namely, it is conceivable that the toner-image detecting sensor 30 is placed at the position P3 before the recording sheet is released toward the fixing unit 25 or the position P4 after the recording sheet is released; however, in the case of the four-tandem-type direct transfer system, four sets of image forming stations and the fixing unit have to be aligned in series, so there is not enough space.

Consequently, it is difficult to install the toner-image detecting sensor 30 at the position P3, so the toner-image detecting sensor 30 is mostly placed at the position P4. Incidentally, in the case of the full-color image forming apparatus of the four-tandem-type direct transfer system shown in FIG. 3, the transfer conveyance belt also serves as an image carrier for carrying thereon a test pattern which is a toner image.

Figure 4:
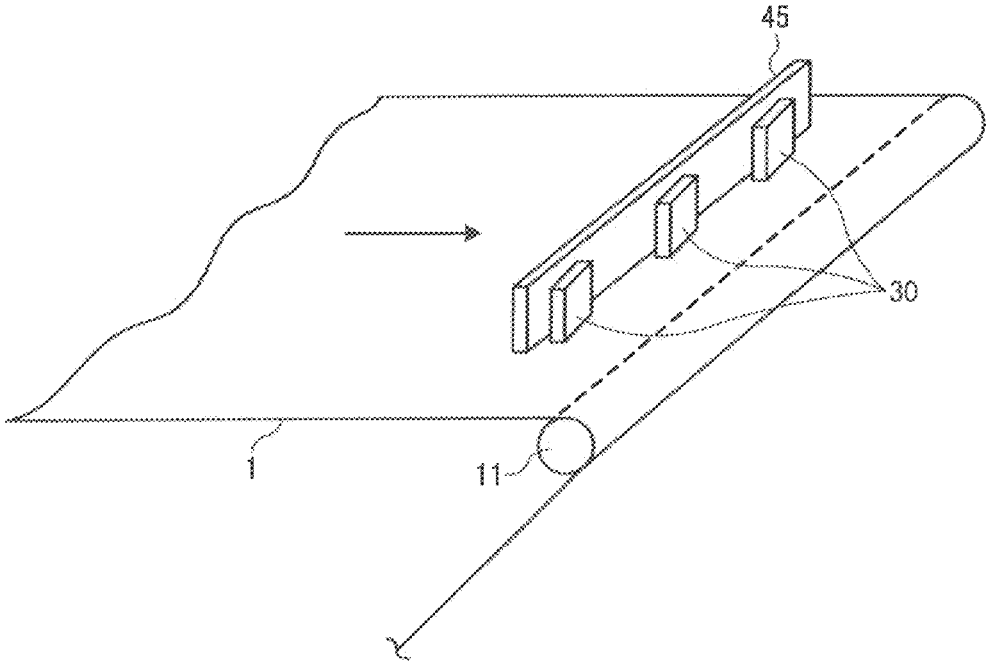
FIG. 4 is a perspective view of a main portion of a toner-image detecting sensor for illustrating placement of the toner-image detecting sensor.

FIG. 4 depicts the image that the toner-image detecting sensor 30 described in FIGS. 1 to 3 is placed. In FIG. 4, the toner-image detecting sensor 30 is placed at the position P1 shown in FIG. 1. This toner-image detecting sensor shown in FIG. 4 is a three-head type sensor in which three toner-image detecting sensors 30 are mounted on a sensor substrate 45; this configuration is an example where a plurality of sensors are placed to be aligned in a main scanning corresponding direction (an axial direction of the photosensitive drum 2) perpendicular to a recording-sheet conveying direction, and the number of the toner-image detecting sensors 30 is not particularly limited to three.

The number of sensor heads (toner-image detecting sensors) can be one; in this case, the sensor head is mostly placed in the center part.

Figure 5:
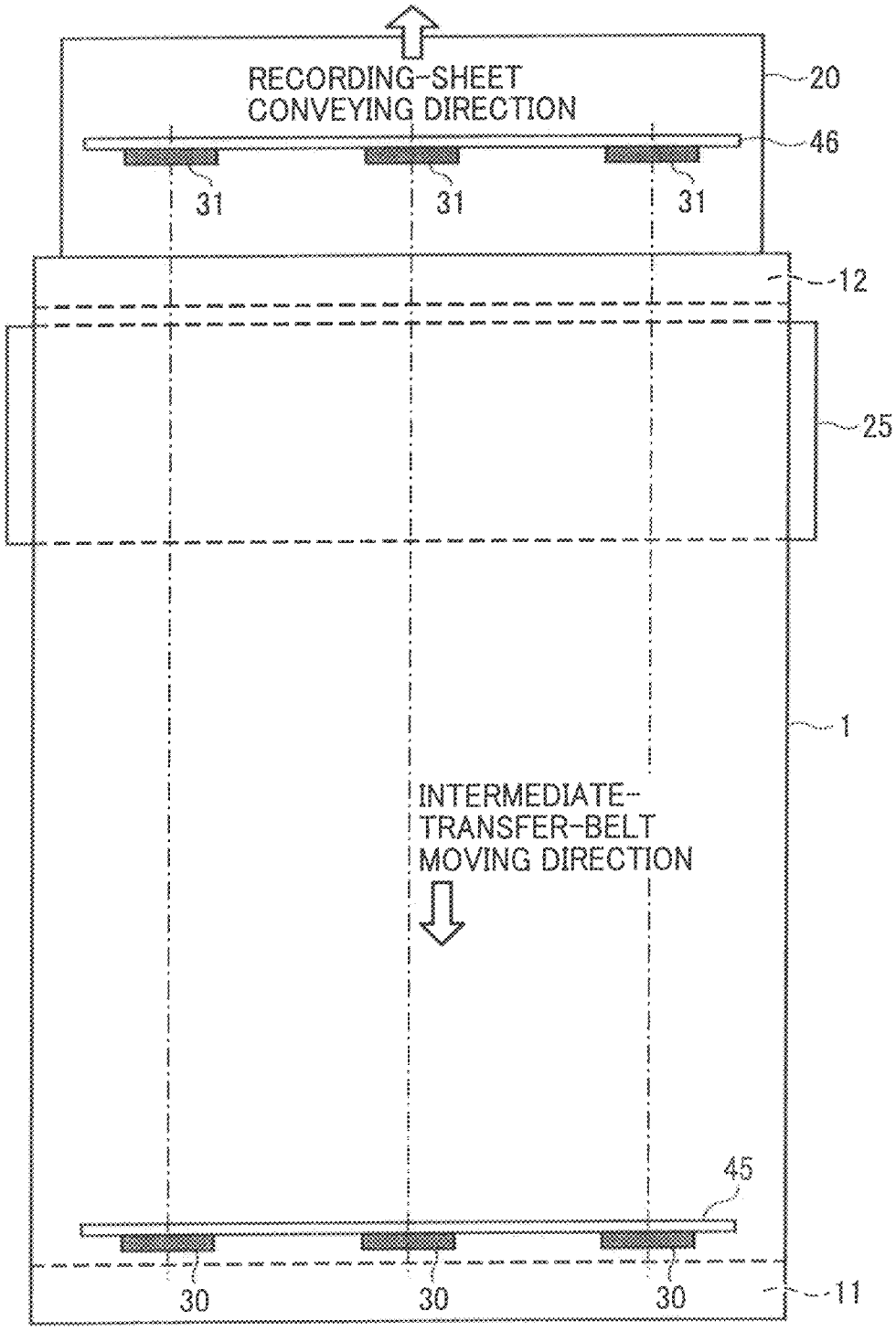
FIG. 5 is a plan view illustrating a positional relation between the toner-image detecting sensor and a fixed-image detecting sensor.

As shown in FIG. 5, both the toner-image detecting sensors 30 and the fixed-image detecting sensors 31 are arranged to be aligned in the main scanning corresponding direction. FIG. 5 shows an overhead view of the intermediate transfer belt 1, the fixing unit 25, the toner-image detecting sensors 30 arranged at the position P1, and the fixed-image detecting sensors 31 of the image forming apparatus shown in FIG. 1. A reference numeral 46 denotes a sensor substrate on which the fixed-image detecting sensors 31 are mounted.

In FIG. 5, the main scanning corresponding direction corresponds to a right-left direction, and both the three toner-image detecting sensors 30 depicted as three heads and the fixed-image detecting sensors 31 are placed so that the positions of the respective heads in the main scanning corresponding direction are aligned.

By arranging the toner-image detecting sensors 30 and the fixed-image detecting sensors 31 in this way, if a toner adhering amount (an image density) in the main scanning corresponding direction is uneven in the process until the test pattern is transferred onto the intermediate transfer belt 1, the sensor heads aligned in the main scanning corresponding direction are equally affected by the effect of the uneven toner adhering amount.

Therefore, when output values of the both sensors are compared, if unevenness of the image density is caused by the processes from the secondary transfer process to the fixing process, by comparing measurement data of the sensor heads aligned in the main scanning corresponding direction, the effect of the uneven image density can be grasped accurately.

In contrast, in the Japanese Patent Application Laid-open No. 2005-321572, as is obvious from FIGS. 6 and 11, the position of a test pattern (a patch pattern) formed on a recording sheet is obviously different from the position of a test pattern formed on an intermediate transfer body, so it is not possible to obtain the above effect made by causing the sensors to be aligned in the main scanning corresponding direction.

The number of sensor heads of each of the toner-image detecting sensor 30 and the fixed-image detecting sensor 31 shown in FIG. 5 is three; this is an example in the case where a plurality of sensors are placed in the main scanning corresponding direction.

Figure 6A:
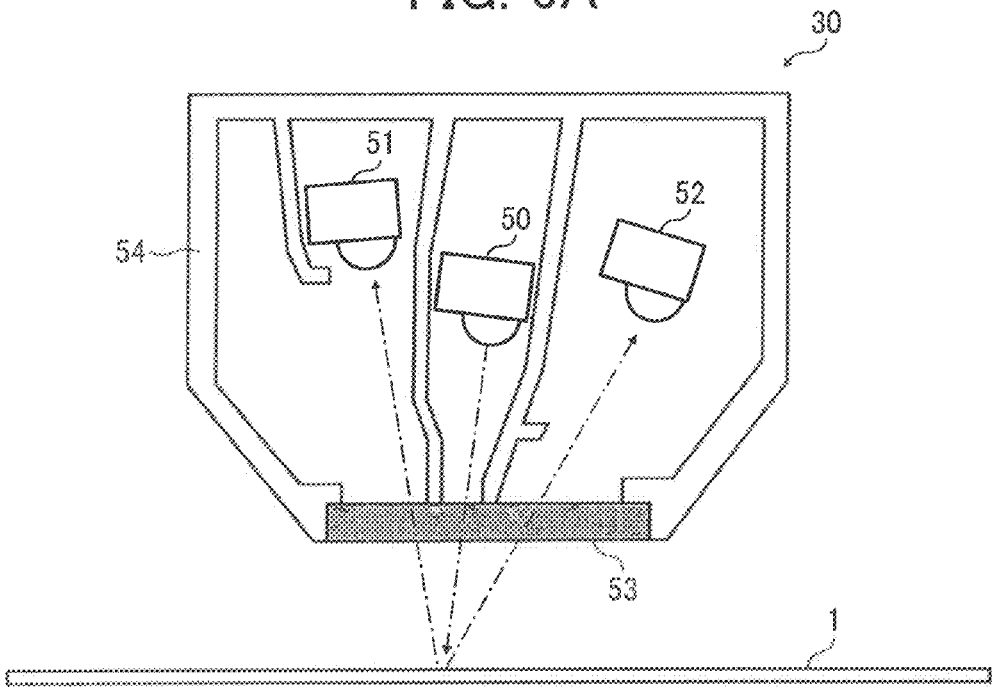
FIG. 6A is a schematic cross-sectional view illustrating a configuration of a one-light emission and two-light reception type of the toner-image detecting sensor.
Figure 6B:
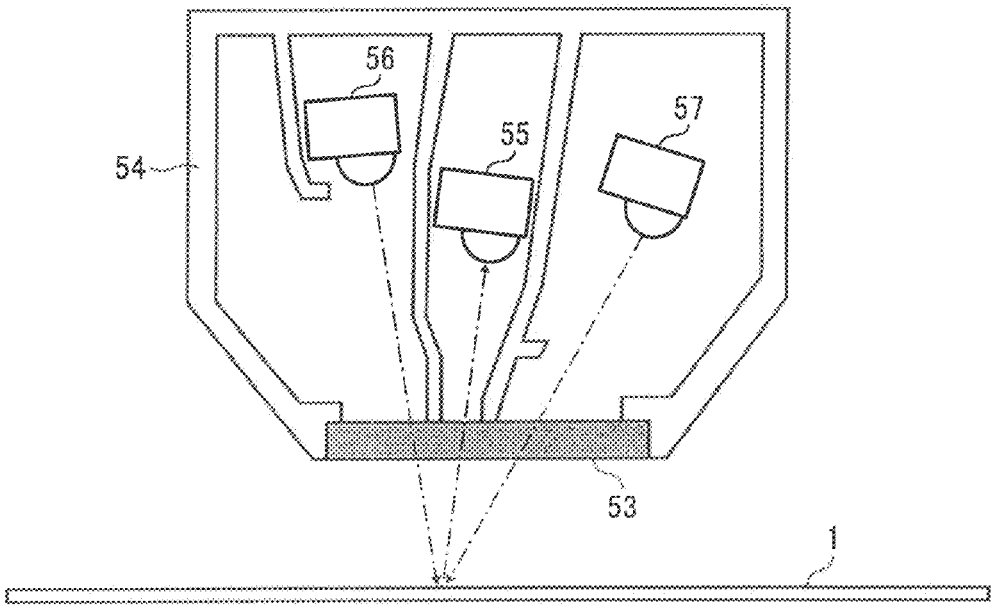
FIG. 6B is a schematic cross-sectional view illustrating a configuration of a two-light emission and one-light reception type of the toner-image detecting sensor.

FIGS. 6A and 6B show configuration examples of the toner-image detecting sensor 30 according to the present embodiment. When the toner-image detecting sensor 30 detects a toner image on the intermediate transfer belt 1 or the transfer conveyance belt 40, in general, the toner-image detecting sensor 30 measures a toner adhering amount on the basis of two reflected lights—a specularly-reflected light and a diffusely-reflected light.

FIG. 6A illustrates an example of a one-light emission and two-light reception type sensor, and FIG. 6B illustrates an example of a two-light emission and one-light reception type sensor; there is no difference between the both sensors in principle except a difference in the usability.

In FIGS. 6A and 6B, a reference numeral 50 denotes a light emitting element, a reference numeral 51 denotes a specular-reflection-side light receiving element, a reference numeral 52 denotes a diffuse-reflection-side light receiving element, a reference numeral 53 denotes a dust-proof glass (or lens), a reference numeral 54 denotes a sensor case, a reference numeral 55 denotes a light receiving element, a reference numeral 56 denotes a specular-reflection-side light emitting element, and a reference numeral 57 denotes a diffuse-reflection-side light emitting element.

A commonly-used material of the intermediate transfer belt, such as polyimide, has a high specular reflectance, and in a state where there is no toner image on the intermediate transfer belt, a specularly-reflected light is strong, and there is little diffusely-reflected light. When a toner image is transferred onto the belt, if it is a black toner image, the black toner blocks a specularly-reflected light, and does not let a diffusely-reflected light through. Namely, although a diffusely-reflected-light detection output does not vary according to a toner adhering amount, a specularly-reflected-light detection output decreases with an increase in toner adhering amount. By using this change, an amount of adhered black toner is detected on the basis of the specularly-reflected light.

On the other hand, when color toner is transferred onto the belt, the color toner blocks a specularly-reflected light, and lets a diffusely-reflected light through. An amount of the diffusely-reflected light increases with an increase in toner adhering amount; therefore, as for color toner, an amount of adhered toner is detected by detection of the diffusely-reflected light.

Figure 7:
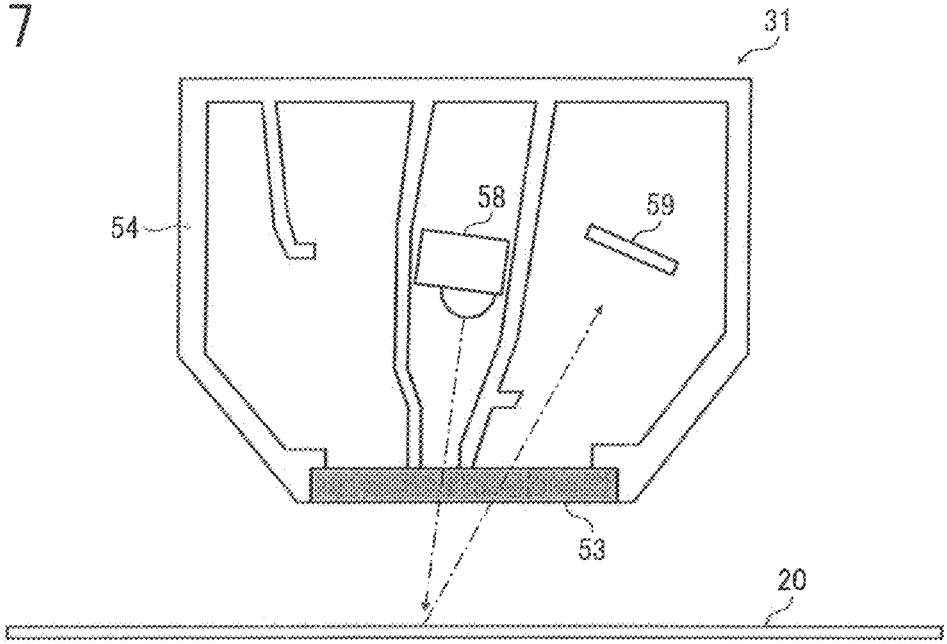
FIG. 7 is a schematic cross-sectional view illustrating a configuration of the fixed-image detecting sensor.

FIG. 7 shows a configuration example of the fixed-image detecting sensor 31 according to the present embodiment.

To detect a fixed image, as used in a commercial color-density measurement device, only a diffusely-reflected light is used. In general, "0-degree light projection, 45-degree light reception" or "45-degree light projection, 0-degree light reception" is used; however, an angular relation is not particularly specified.

In the example shown in FIG. 7, the light emitting element 58 is a white light-emitting LED. This is because a light has to include the full band of wavelength to detect a color patch. A light receiving element 59 with an RGB filter is used as a light receiving element, and can output respective intensities of received RGB lights separately.

By such a configuration, the fixed-image detecting sensor 31 can measure the color and its density when a recording sheet on which test patterns for the YMCK colors are fixed is conveyed. Incidentally, in the example shown in FIG. 7, the light receiving side sorts the color into RGB; alternatively, it can be configured that, for example, a light receiving element having a sensitivity to a received light in the broadband of optical wavelength is used in the light receiving side, and the light emitting side is RGB-filter so as to emit a light selectively.

The image forming apparatus according to the present embodiment includes, as a control means, a control unit (not shown). The control unit includes a central processing unit (CPU) as a computing means, a nonvolatile random access memory (RAM) as a data storage means, a read only memory (ROM) as a data storage means, and the like. The electric charger 3, the writing unit 4, the developing unit 5, the toner-image detecting sensor 30, the fixed-image detecting sensor 31, and the like are electrically connected to the control unit. Then, the control unit controls these various devices on the basis of a control program stored in a RAM 102 or a ROM 103.

The control unit (not shown) also controls the image forming conditions for forming an image. Specifically, the control unit controls the application of a charging bias to each of the chargers 3 for the YMCK colors individually. Consequently, each of the photosensitive drums 2Y, 2M, 2C, and 2K is uniformly charged to have a corresponding electrical potential for each of the Y, M, C, and K drums. Furthermore, the control unit controls the power of each of four semiconductor lasers corresponding to the writing units 4 for the YMCK colors individually. Moreover, the control unit controls the application of a developing bias of a developing bias value for each of the Y, M, C, and K colors to the corresponding developing roller. Consequently, each of electrostatic latent images on the photosensitive drums 2Y, 2M, 2C, and 2K is developed into a toner image by causing a developing potential for electrostatically transferring toner from the side of the surface of a sleeve to the side of the photosensitive element to act on between the electrostatic latent image and a developing sleeve.

Furthermore, the control unit (not shown) performs the image adjustment operation for making the image density of each color appropriate each time the power is on or the predetermined number of sheets is printed out. In the present embodiment, there are two image adjustment modes—a first image adjustment mode and a second image adjustment mode. Namely, the control unit (not shown) serves as a first image adjusting unit and a second image adjusting unit.

Figure 8A:
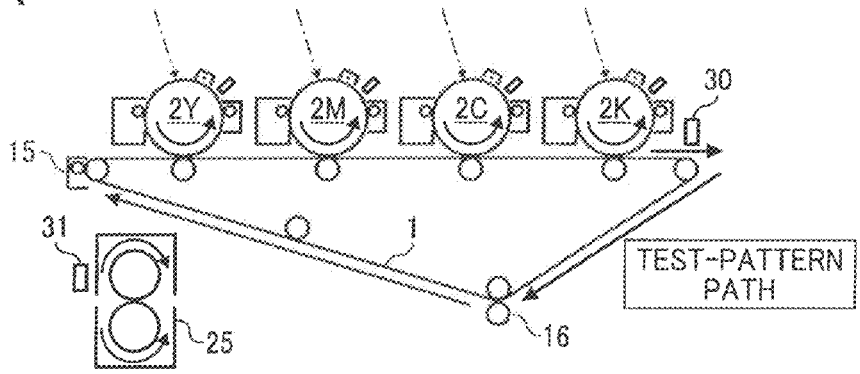
FIG. 8A is a diagram illustrating a test-pattern path in a first image adjustment mode when the toner-image detecting sensor is placed on the upstream side of a secondary transfer section in an intermediate-transfer-belt moving direction.
Figure 8B:
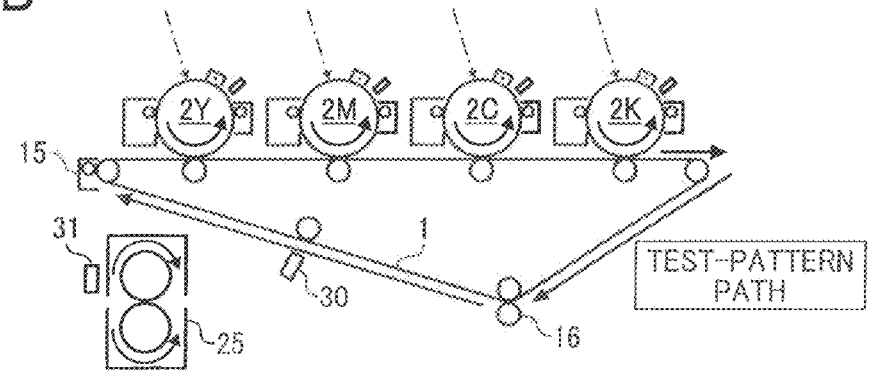
FIG. 8B is a diagram illustrating a test-pattern path in the first image adjustment mode when the toner-image detecting sensor is placed on the downstream side of the secondary transfer section in the intermediate-transfer-belt moving direction.

FIGS. 8A and 8B show test-pattern conveying paths in the first image adjustment mode.

A machine configuration is the full-color image forming apparatus of the four-tandem-type intermediate transfer system shown in FIG. 1.

In the case of the configuration where the toner-image detecting sensor 30 is placed at the position 21 shown in FIG. 1, as shown in FIG. 8A, after the toner-image detecting sensor 30 detects a test pattern formed on the intermediate transfer belt 1, the test pattern is not secondarily transferred onto a recording sheet but conveyed to the intermediate-transfer-belt cleaning unit 15, and the test pattern on the intermediate transfer belt 1 is removed by the intermediate-transfer-belt cleaning unit 15.

In the case of the configuration where the toner-image detecting sensor 30 is placed at the position P2 shown in FIG. 1, as shown in FIG. 8B, after the toner-image detecting sensor 30 detects a test pattern which has passed through the secondary transfer process, the test pattern is not secondarily transferred onto a recording sheet but conveyed to the intermediate-transfer-belt cleaning unit 15, and the test pattern on the intermediate transfer belt 1 is removed by the intermediate-transfer-belt cleaning unit 15.

Figure 9A:
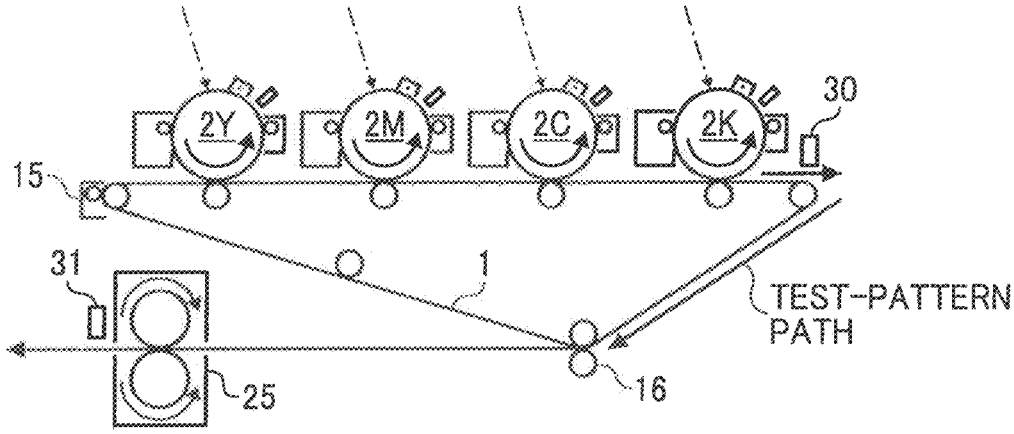
FIG. 9A is a diagram illustrating a test-pattern path in a second image adjustment mode in the image forming apparatus shown in FIG. 1 when the two sensors detect the same object.
Figure 9B:
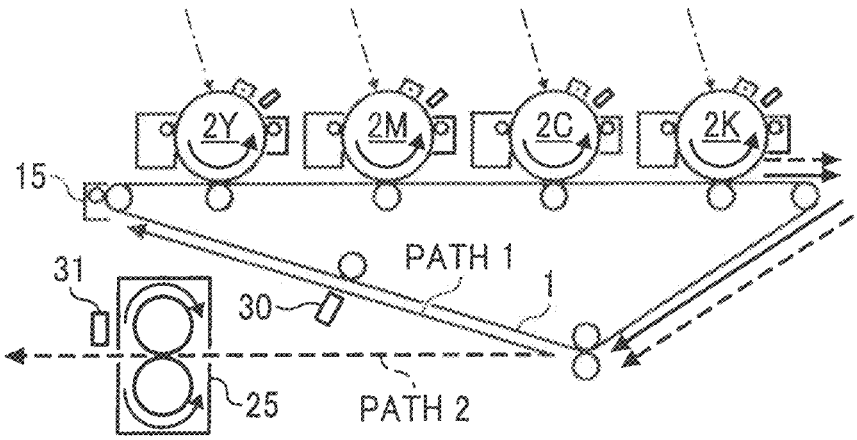
FIG. 9B is a diagram illustrating a test-pattern path in the second image adjustment mode in the image forming apparatus shown in FIG. 1 when the two sensors detect different objects.

FIGS. 9A and 9B show test-pattern conveying paths in the second image adjustment mode.

A machine configuration is the full-color image forming apparatus of the four-tandem-type intermediate transfer system shown in FIG. 1.

In the case of the configuration where the toner-image detecting sensor 30 is placed at the position P1 shown in FIG. 1, as shown in FIG. 9A, after the toner-image detecting sensor 30 detects a test pattern formed on the intermediate transfer belt 1, the test pattern is transferred onto a recording sheet in the secondary transfer roller section, and fixed on the recording sheet in the fixing unit section, and after that, the fixed-image detecting sensor 31 detects the test pattern.

In the case of the configuration where the toner-image detecting sensor 30 is placed at the position P2 shown in FIG. 1, as shown in FIG. 9B, after a test pattern formed on the intermediate transfer belt passes through the secondary transfer process, the toner-image detecting sensor 30 detects the test pattern. The test pattern which has passed through the toner-image detecting sensor 30 is cleaned by the intermediate-transfer-belt cleaning unit 15, and the test pattern on the intermediate transfer belt 1 is removed by the intermediate-transfer-belt cleaning unit 15 (a path 1 indicated by a solid line in the drawing). Then, another test pattern is formed on the intermediate transfer belt under the same image forming conditions, and the test pattern is transferred onto a recording sheet in the secondary transfer roller section, and then fixed on the recording sheet in the fixing unit section, and after that, the fixed-image detecting sensor 31 detects the test pattern (a path 2 indicated by a dashed line in the drawing).

By employing the configuration where the toner-image detecting sensor 30 is placed at the position P1 shown in FIG. 1, the same object test pattern can be detected by the toner-image detecting sensor 30 and the fixed-image detecting sensor 31, and the accuracy of detection can be increased. In the configuration where the toner-image detecting sensor 30 is placed at the position P2 shown in FIG. 1, as shown in FIG. 9B, a test pattern detected by the toner-image detecting sensor 30 cannot be detected by the fixed-image detecting sensor 31, so another test pattern has to be prepared and conveyed to the fixed-image detecting sensor 31. In this case, the two test patterns are formed under the same image forming conditions; however, even if they are the patterns formed under the same image forming conditions, an amount of adhered toner of each of the test patterns is not always the same amount, so when detection outputs of the two sensors are compared, the output includes an error of the toner adhering amount as an error factor. Therefore, in terms of reliability of a detection result, it is preferable to cause the two sensors to detect the same object test pattern rather than different object test patterns.

Meanwhile, there are many models of image forming apparatuses in which the toner-image detecting sensor 30 can be placed only at the position P2 because of space limitations; conversely, the placement of the sensor at this position has the advantage that an increase in size of the machine is prevented. In this manner, when the reliability of detection is emphasized, detection of "the same object" has an advantage; on the other hand, when the machine size is emphasized, detection of "different objects" has an advantage.

Which to choose depends on a strategy of each model, so it is not necessarily appropriate to suggest that which system is better.

When a test pattern detected by the toner-image detecting sensor 30 and a test pattern detected by the fixed-image detecting sensor 31 are "different objects", the width of the test pattern detected by the fixed-image detecting sensor 31 can be larger than that of the test pattern detected by the toner-image detecting sensor 30. The above-described fixed-image detecting sensor 31 detects a diffusely-reflected light, so the broader the detection area, the higher the detection sensitivity. On the other hand, the toner-image detecting sensor 30 detects a toner adhering amount on the basis of a specularly-reflected light and a diffusely-reflected light; however, if the detection area is broadened, the sensitivity to the specularly-reflected light is decreased, so the narrow detection area is preferable. Therefore, the width of the test pattern detected by the fixed-image detecting sensor 31 is larger than that of the test pattern detected by the toner-image detecting sensor 30, whereby the detection sensitivity of the fixed-image detecting sensor 31 can be increased, and a good detection result can be obtained.

Figure 10A:
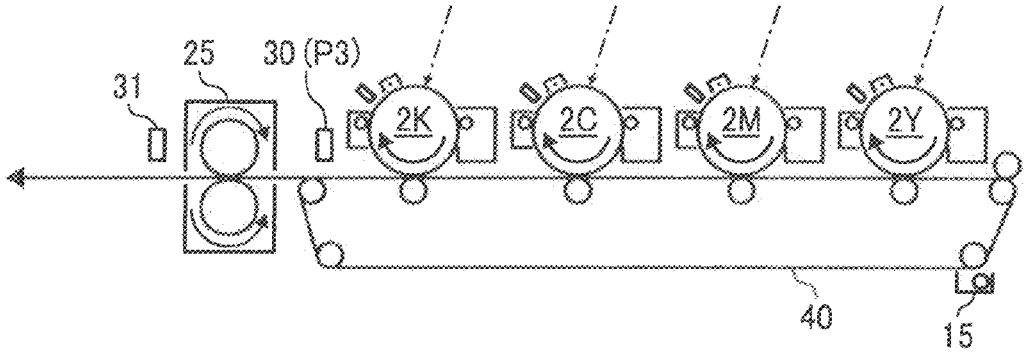
FIG. 10A is a diagram illustrating a test-pattern path in the second image adjustment mode in the image forming apparatus shown in FIG. 3 when the two sensors detect the same object.
Figure 10B:
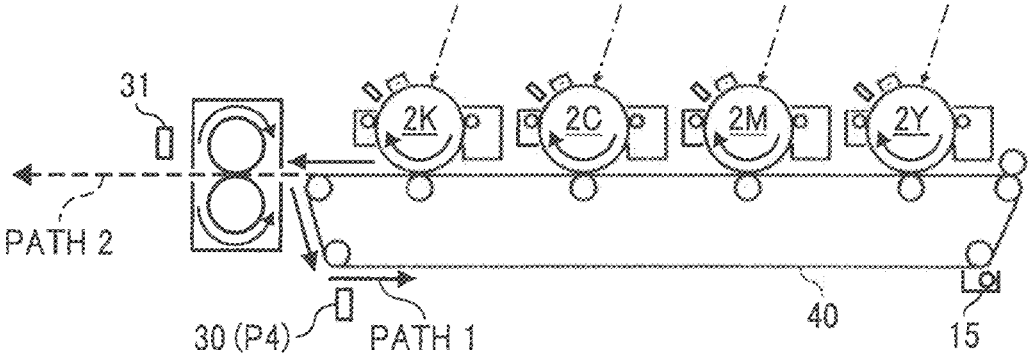
FIG. 10B is a diagram illustrating a test-pattern path in the second image adjustment mode in the image forming apparatus shown in FIG. 3 when the two sensors detect different objects.

FIGS. 10A and 10B show examples of a test-pattern conveying path in the second image adjustment mode in the case of the four-tandem-type direct transfer system shown in FIG. 3. A difference between the direct transfer system and the intermediate transfer system is that in the direct transfer system, the both sensors detect a test pattern transferred onto a recording sheet.

When the sensors detect "different objects", the toner-image detecting sensor 30 detects a test pattern transferred onto the transfer conveyance belt 40 (a path 1 shown in FIG. 10B), and the fixed-image detecting sensor 31 detects an image fixed on a recording sheet (a path 2 shown in FIG. 10B).

The content other than the above difference is the same as that is described in FIGS. 9A and 9B. Incidentally, also in the configuration shown in FIG. 10A, for convenience of detection characteristics of the toner-image detecting sensor 30, the toner-image detecting sensor 30 may have to detect a test pattern on the transfer conveyance belt 40.

Namely, if the detection on a recording sheet does not work well, it is necessary to form separate test patterns which respectively pass through the two paths shown in FIG. 10B. This is because a pattern once transferred onto the side of the transfer conveyance belt 40 cannot be transferred onto a recording sheet.

Incidentally, when it is in the first image adjustment mode, even if the toner-image detecting sensor 30 is placed at the position P3, a pattern is transferred onto not a recording sheet but the transfer conveyance belt 40, and the toner-image detecting sensor 30 detects the pattern on the transfer conveyance belt.

Figure 11A:
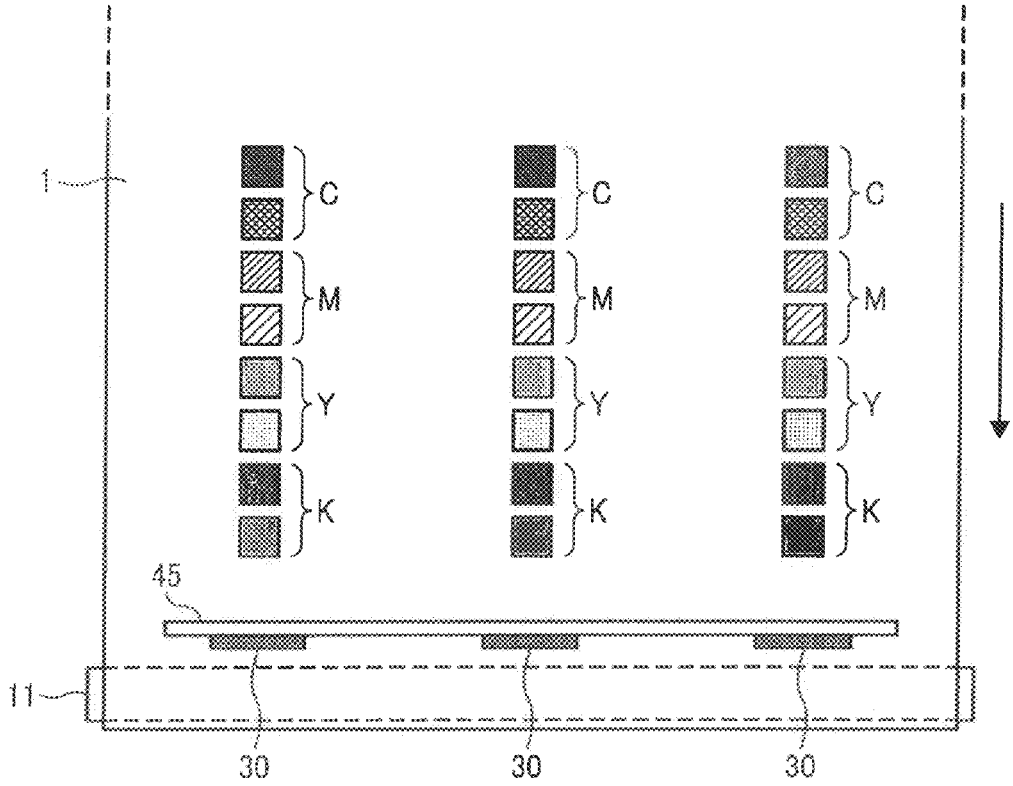
FIGS. 11A and 11B are diagrams illustrating examples of a configuration when a test pattern in the first image adjustment mode and a test pattern in the second image adjustment mode are the same test pattern.
Figure 11B:
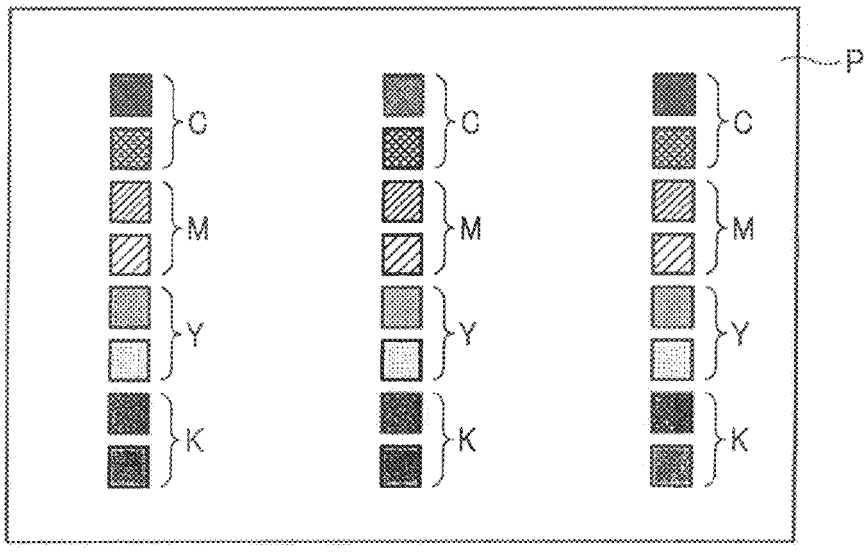

FIGS. 11A and 11B show configuration examples of a test pattern formed at the execution of image adjustment in the first image adjustment mode and a test pattern formed at the execution of image adjustment in the second image adjustment mode.

FIG. 11A shows a configuration example of a test pattern formed on the intermediate transfer belt at the execution of image adjustment in the first image adjustment mode. FIG. 11B shows a configuration example of a test pattern formed on a recording sheet at the execution of image adjustment in the second image adjustment mode.

The YMCK-color test pattern in the first image adjustment mode and the second image adjustment mode is composed of a K-color gradation pattern, a Y-color gradation pattern, an M-color gradation pattern, and a C-color gradation pattern which are each composed of a plurality of toner patches of different toner adhering amounts and formed on the intermediate transfer belt 1 in this order.

As shown in FIGS. 11A and 11B, the same test pattern is used in the both image adjustment modes. In the second image adjustment mode, the test pattern is formed on a recording sheet, so it is preferable that the test pattern has the size capable of fitting in one recording sheet. If the test pattern does not fit in one recording sheet, the test pattern is formed over several recording sheets; however, the recording sheet is a user's belonging, so it is not preferable to unnecessarily increase the number of sheets consumed. FIG. 11B depicts the image that the test pattern fits in an A4 landscape recording sheet. As the same test pattern is used in the first image adjustment mode and the second image adjustment mode, it is possible to save an area of memory for storing the test pattern.

Figure 12A:
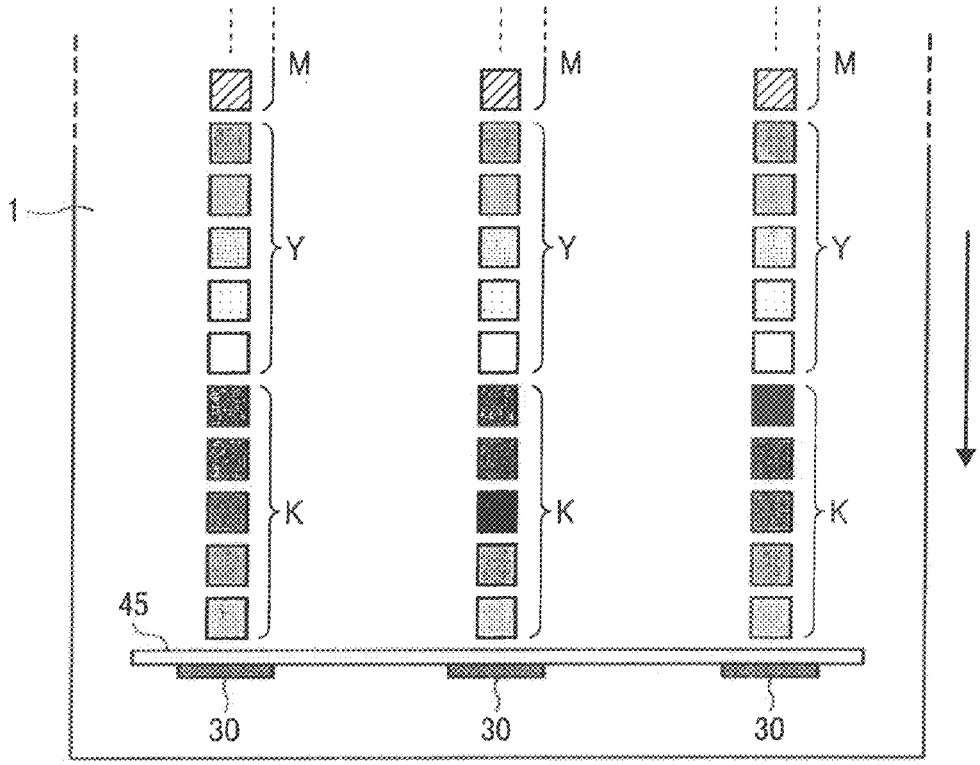
FIGS. 12A and 12B are diagrams illustrating examples of a configuration when a test pattern in the first image adjustment mode and a test pattern in the second image adjustment mode are different test patterns.
Figure 12B:
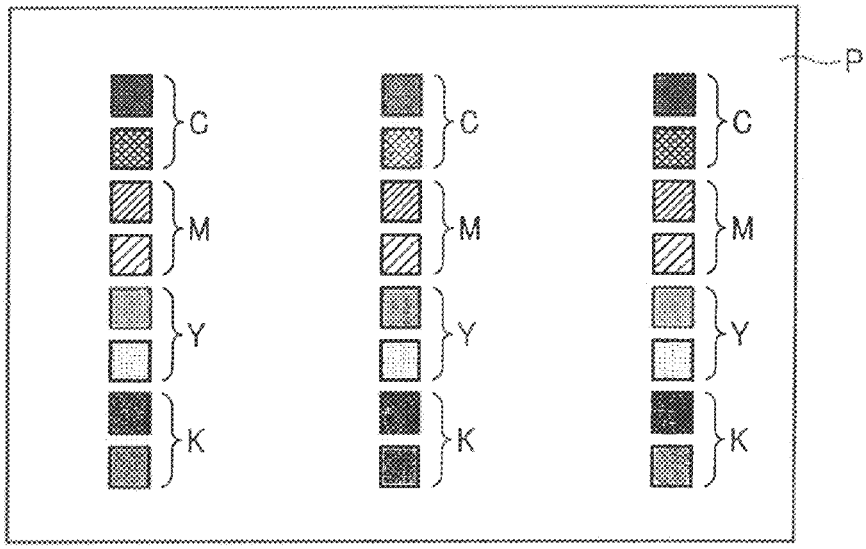

Furthermore, as shown in FIGS. 12A and 12B, the test pattern can differ between the first image adjustment mode and the second image adjustment mode. As shown in FIG. 12B, a test pattern in the second image adjustment mode has the length capable of fitting in an A4 landscape recording sheet in the same manner as the test pattern shown in FIGS. 11A and 11B. On the other hand, as shown in FIG. 12A, a test pattern in the first image adjustment mode is formed without caring if it fits in one recording sheet, and the number of toner patches included in each gradation pattern is greater than that of in the second image adjustment mode. This is because, as described above, in the first image adjustment mode, the test pattern is formed on the intermediate transfer belt, and then removed from the intermediate transfer belt without being transferred onto a recording sheet, so the recording sheet doesn't matter. The greater the number of toner patches included in each gradation pattern (the number of gradations), the more accurately the developing characteristics can be preferably grasped. However, if the number of toner patches included in each gradation pattern is increased, toner consumption is increased, and also the image adjustment takes a longer time, i.e., it takes a longer wait time. In consideration of the toner consumption and the wait time, it is preferable that the number of gradations is about ten at the most. In this manner, in the first image adjustment mode, there is no need to care if the test pattern fits in one recording sheet; therefore, by increasing the number of toner patches (the number of gradations), a test pattern can be compose of toner patches with the originally-required size and number of gradations from the aspect of control performance. Consequently, the feedback control accuracy can be improved. However, on the negative side, an extra pattern storage area is required.

In the process after the secondary transfer (the fixing process in the case of the four-tandem-type direct transfer system shown in FIG. 3), if it can be determined that there is a possibility of image degradation, the image forming apparatus according to the present embodiment executes the image adjustment in the second image adjustment mode, and performs the image adjustment in the first image adjustment mode on a regular basis. Specifically, image degradation in the process after the secondary transfer is determined on the basis of environmental information and the number of printed sheets. An environmental sensor (a temperature and humidity sensor) is placed in the image forming apparatus, and the control unit determines whether there is a possibility of image degradation in the process after the secondary transfer on the basis of information from the temperature and humidity sensor. Although the placement position of the environmental sensor (the temperature and humidity sensor) differs depending on a model of the image forming apparatus, the environmental sensor (the temperature and humidity sensor) is mostly placed on the sheet conveying path or near the sheet tray. As an environmental factor affecting the image degradation, the influence of humidity is stronger than that of temperature. Therefore, the image forming apparatus is set to execute the image adjustment in the second image adjustment mode, for example, if the humidity exceeds 70 [% RH]. However, when the image adjustment in the second image adjustment mode is put into action only in this condition, if the humidity is around a threshold value (70 [% RH]), the adjustment is frequently made. Consequently, to make the frequently of the second image adjustment mode appropriate, for example, determination on the basis of the environmental factor is performed with respect to each of the predetermined number of sheets to make the frequently of the adjustment operation appropriate.

Furthermore, image degradation in the process after the secondary transfer is caused due to time degradation of the fixing roller or the secondary transfer roller. Consequently, image degradation in the process after the secondary transfer due to time degradation is determined on the basis of the number of printed sheets.

Figure 13:
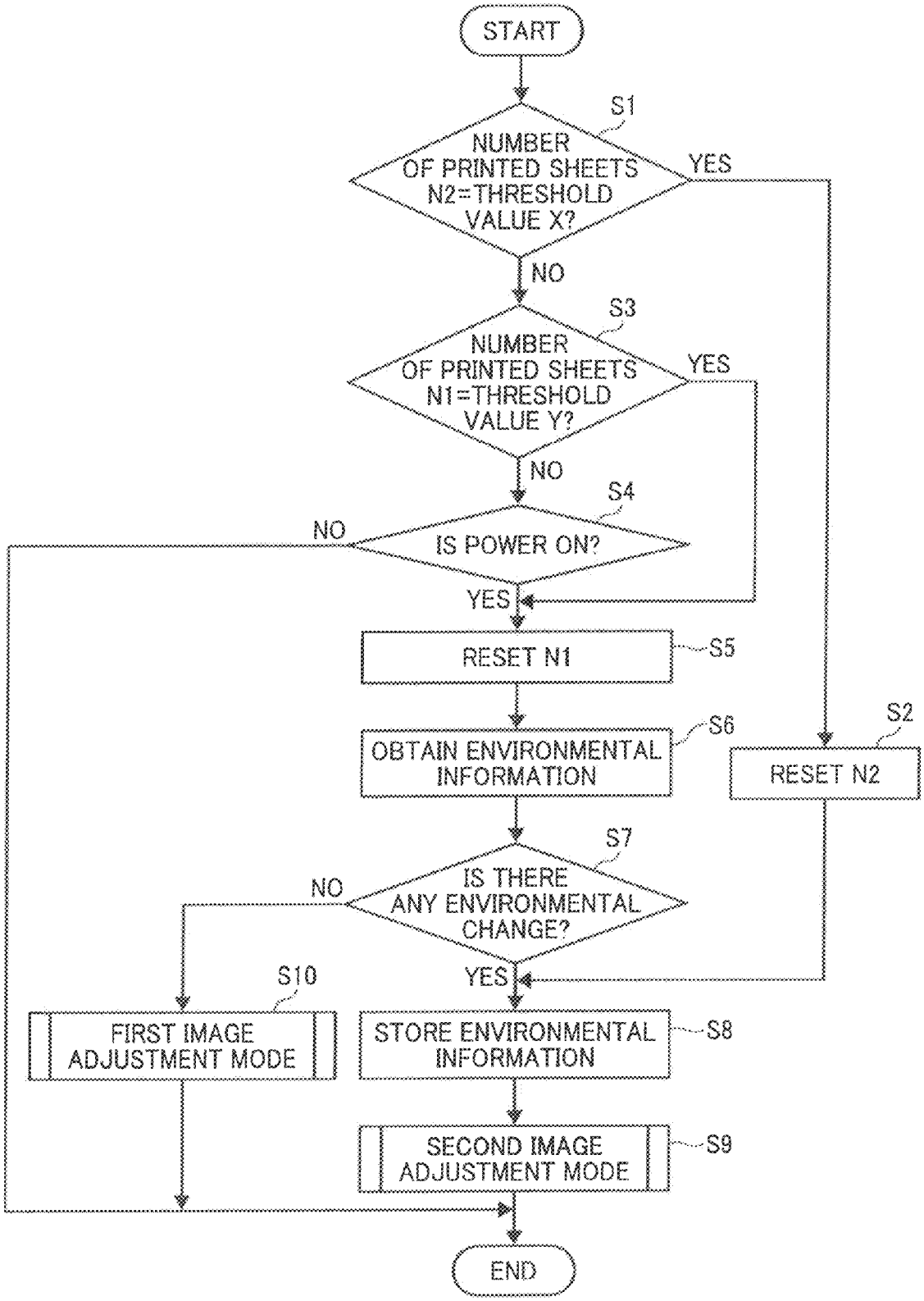
FIG. 13 is a flowchart of how to determine which one of the first and second image adjustment modes of image adjustment is to be executed.

FIG. 13 shows a determination flow of how to determine which one of the first and second image adjustment modes of image adjustment is to be executed.

The control unit (not shown) determines whether the number of printed sheets N2 counted for determining image degradation due to time degradation of the fixing roller or the secondary transfer roller has reached a threshold value X (Step S1). The threshold value X is a value obtained on the basis of an experiment made to investigate a relationship between the degradation of the fixing roller or the secondary transfer roller and the image degradation, and is a value ranging from several thousand to several hundred thousand. When the number of printed sheets N2 has reached the threshold value (YES at Step S1), the control unit resets the number of printed sheets N2 to zero (Step S2), and stores information on the temperature and humidity at the time as environmental information (Step S8), and executes the image adjustment in the second image adjustment mode (Step S9). Alternatively, the number of overall sheets is counted from the initial period, and the image adjustment in the second image adjustment mode can be executed if the number of overall sheets has reached a predetermined value.

On the other hand, when the number of printed sheets N1, which is counted for regularly performing the image adjustment, has reached a threshold value Y (YES at Step S3), or just after the power is on (YES at Step S4), the control unit resets the count value N1 to zero (Step S5). The threshold value Y is a value of several hundred. Then, after the number of printed sheets N1 is reset to zero, the control unit obtains information on the temperature and humidity as environmental information from the temperature and humidity sensor set up in the main body of the apparatus (Step S6). Information on the temperature and humidity at the time when the image adjustment in the second image adjustment mode was executed last time is stored in a nonvolatile memory in the control unit, and the control unit compares the obtained temperature and humidity information with the temperature and humidity information stored in the nonvolatile memory (Step S7). The nonvolatile memory of the control unit holds, for example, a humidity of 70 [% RH] as a high humidity threshold value. If the obtained humidity exceeds 70 [% RH], and the humidity at the time when the image adjustment in the second image adjustment mode was executed last time is 70 [% RH] or less, the control unit determines that the environment is changed from the middle-humidity environment to the high-humidity environment. When the environment is changed in this manner (YES at Step S2), there is a possibility of image degradation in the process after the secondary transfer, so the control unit stores the environmental information (the temperature and humidity) at the time in the nonvolatile memory (Step S8), and executes the image adjustment in the second image adjustment mode (Step S9).

On the other hand, for example, if the obtained humidity exceeds 70 [% RH], and the humidity at the time when the image adjustment in the second image adjustment mode was executed last time also exceeds 70 [% RH], the control unit determines that the environment is not changed (NO at Step S7). Incidentally, a low humidity threshold value is also stored in the nonvolatile memory of the control unit, and the control unit can be configured to execute the image adjustment in the second image adjustment mode if the environment is changed in humidity from the time when the image adjustment in the second image adjustment mode was executed last time—from the low humidity to the middle humidity or from middle humidity to the low humidity.

Furthermore, when the power is on, or after several hundred sheets are printed out, even if the humidity is around a threshold value (for example, 70 [% RH]), determination of a possibility of image degradation in the process after the secondary transfer due to the above environmental factor does not lead to the frequent image adjustment in second image adjustment mode.

On the other hand, if the control unit determines that the environment is not changed (NO at Step S7), the control unit executes the image adjustment in the first image adjustment mode.

Subsequently, the first image adjustment mode is explained in detail.

In the flow shown in FIG. 13, if the first image adjustment mode is selected, a test pattern as shown in FIG. 11A or FIG. 12A is formed on the intermediate transfer belt 1 on the basis of test pattern information (information on the shape of toner patch, the number of toner patches included in each color gradation pattern, etc.) stored in a pattern storage area of the nonvolatile memory of the control unit. Then, the test pattern formed on the intermediate transfer belt is detected by the toner-image detecting sensor 30 in accordance with the endless movement of the intermediate transfer belt.

Then, an output value of the toner-image detecting sensor 30 obtained by detecting each toner patch of each color gradation pattern of the test pattern is converted into a toner adhering amount (an image density) of each toner patch using a toner adhering amount calculating algorithm constructed on the basis of a relation between a toner adhering amount and an output value.

After the toner adhering amount of each toner patch included in each color gradation pattern is calculated, the image forming conditions are adjusted on the basis of the respective toner patches in each color gradation pattern. A plurality of toner patches in each of the gradation pattern for Y, M, C, and K colors are each formed by being developed by a combination of a different drum charging potential and a developing bias, and a toner adhering amount (an image density) per unit area is gradually increased. This toner adhering amount is correlated with a developing potential which is a difference between the drum charging potential and the developing bias, so a relation between the two is represented by an approximately straight line graph on a two-dimensional coordinate.

The control unit calculates a function representing the straight line graph ($y=ax+b$) by regression analysis on the basis of a detection result of the toner adhering amount of each toner patch and the developing potential at the time when the toner patch is formed. The control unit adjusts parameters (a developing bias, a charging bias, an exposure amount, and the like) of the image forming process performed on the upstream side of the toner-image detecting sensor in the toner-image moving direction on the basis of a result of the calculation.

Subsequently, the second image adjustment mode is explained in detail.

In the flow shown in FIG. 13, if the second image adjustment mode is selected, a test pattern as shown in FIG. 11B or FIG. 12B is formed on the intermediate transfer belt 1 on the basis of test pattern information (information on the shape of toner patch, the number of toner patches included in each color gradation pattern, etc.) stored in the pattern storage area of the nonvolatile memory of the control unit. Then, the test pattern formed on the intermediate transfer belt is detected by the toner-image detecting sensor 30 in accordance with the endless movement of the intermediate transfer belt. After that, the test pattern on the intermediate transfer belt is transferred onto a recording sheet, and fixed on the recording sheet, and after that, the test pattern is detected by the fixed-image detecting sensor.

Figure 14A:
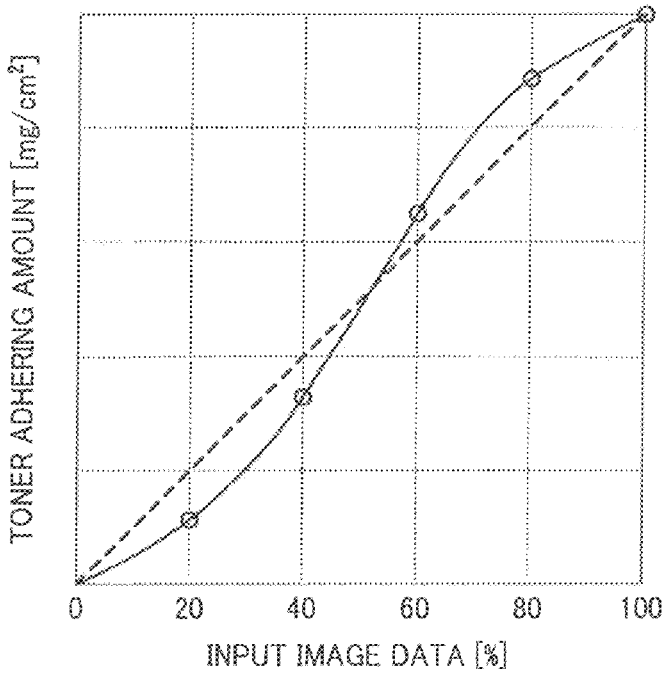
FIG. 14A is a graph showing measurement data of the toner-image detecting sensor at the execution of image adjustment in the second image adjustment mode.
Figure 14B:
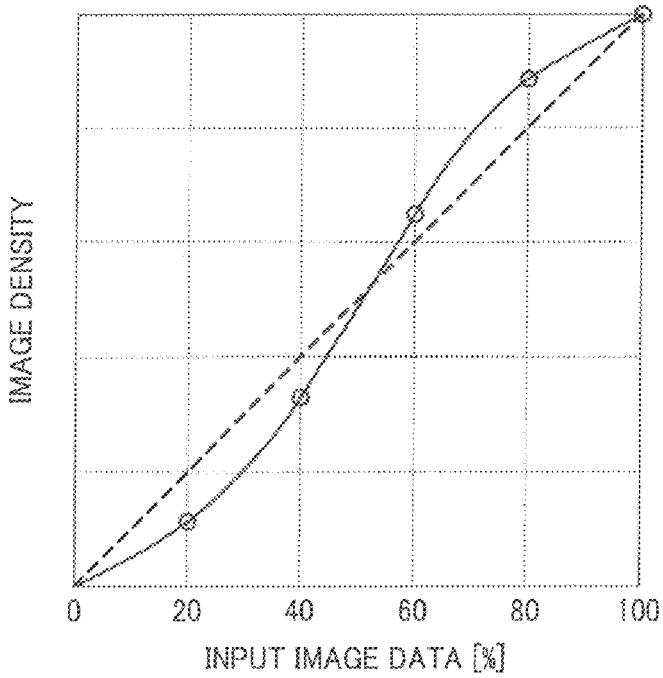
FIG. 14B is a graph showing measurement data of the fixed-image detecting sensor at the execution of image adjustment in the second image adjustment mode.

FIGS. 14A and 14B show examples of measurement data obtained when the test pattern shown in FIG. 11B or FIG. 12B is measured by the toner-image detecting sensor 30 and the fixed-image detecting sensor 31. FIG. 14A shows data on toner adhering amount measured by the toner-image detecting sensor 30. FIG. 14B shows data on image density measured by the fixed-image detecting sensor 31.

The live output of each sensor is measured by the volt ([V]), of course; however, the output of each sensor is shown as data on toner adhering amount and data on image density into which voltage information is converted by calibration curve of the sensor characteristics estimated in advance. When five gradation patterns of which the density is gradually increased by 20% are formed as input image data, typically, characteristics of the toner adhering amount and characteristics of the image density transition as shown in FIGS. 14A and 14B.

Figure 15A:
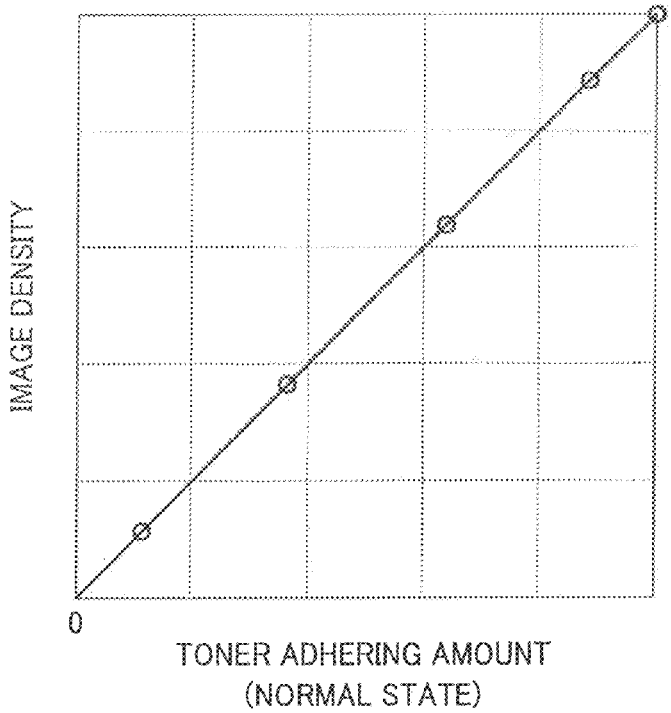
FIG. 15A is a graph showing an example of comparison of the measurement data in FIG. 13 when it is in a normal state.

FIG. 15A shows comparison of typical output values of the two sensors. The lateral axis indicates a toner adhering amount on the intermediate transfer belt, and the vertical axis indicates an image density on a recording sheet. If the outputs of the two sensors show typical characteristics as shown in FIGS. 14A and 14B, a relation between the two is a nearly linear state as shown in FIG. 15A.

Actually, the graph is slightly distorted with respect to each model and each color, and it is not exactly linear; however, a relation between data of the two sensors in the normal state as shown in FIG. 15A is recognized, and this relation is set down as a fundamental correlation.

Figure 15B:
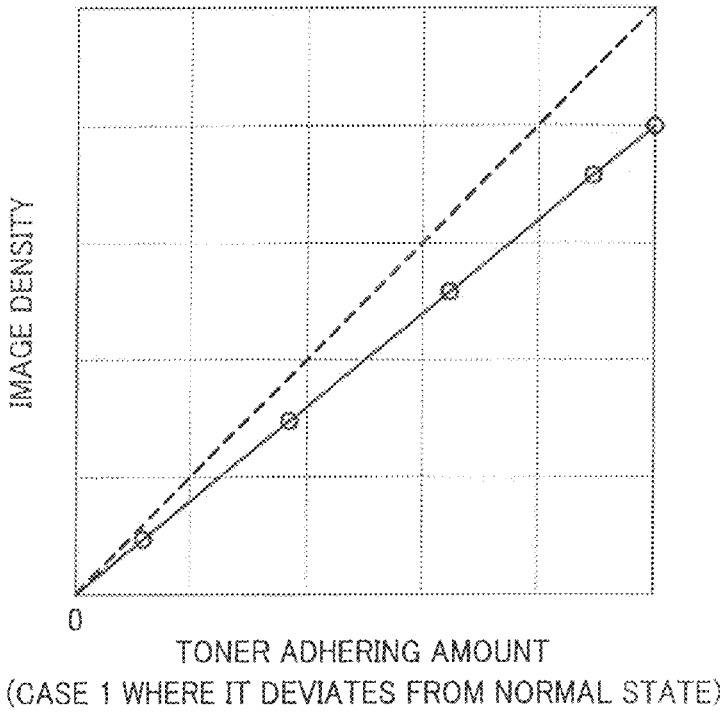
FIG. 15B is a graph showing an example of comparison of the measurement data in FIG. 13 when it deviates from the normal state.

If it is detected that this fundamental correlation is out of line as shown in FIG. 15B at a certain point of time (when the process control for the transfer of a test pattern onto a recording sheet is implemented), even though a toner adhering amount is normal, an image density is lower than the fundamental correlation, and therefore, it can be determined that a problem arises in the process from the secondary transfer process to the fixing process.

In this case, there is fear that transfer omission is increased in the secondary transfer, so the feedback control is made to adjust a secondary transfer bias (or a secondary transfer current). Furthermore, if it is known that a fluctuation as shown in FIG. 15B is caused by a fluctuation of fixing conditions, the fixing conditions are also subject to the control.

Figure 16A:
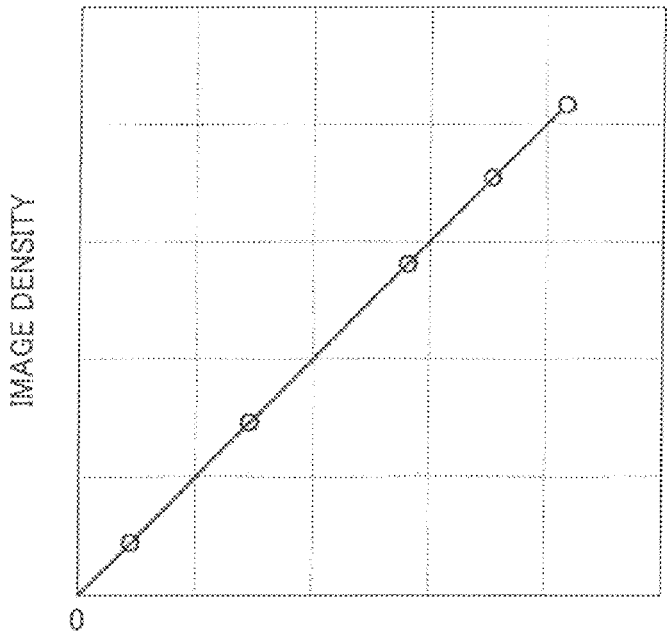
FIG. 16A is a graph showing another example of comparison of the measurement data in FIG. 13 when it deviates from the normal state.

When the fundamental correlation shown in FIG. 15A is out of line as shown in FIG. 16A, the relation between toner adhering amount and image density is not collapsed; however, it turns out that there is a shortage of a toner adhering amount. In this case, a problem arises in the process before the secondary transfer process, so image forming parameters for increasing the toner adhering amount (a developing bias, a charging bias, an exposure amount, and the like) are subject to the feedback control.

Figure 16B:
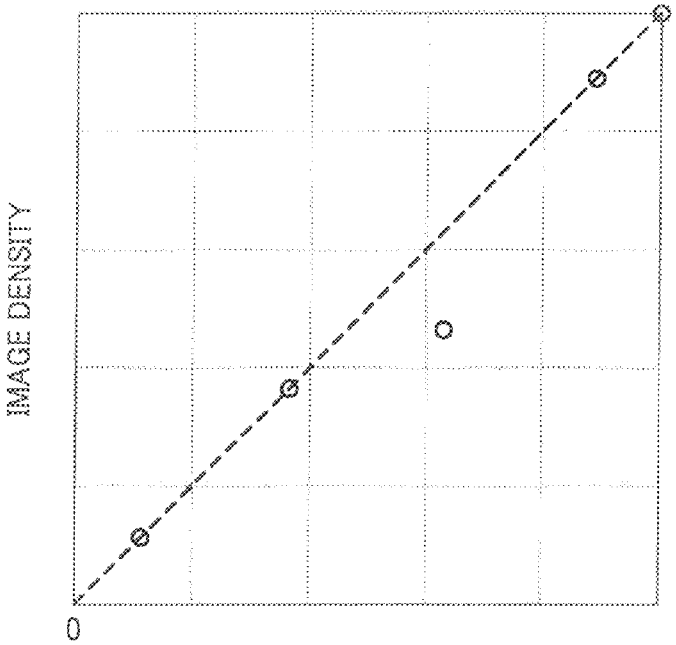
FIG. 16B is a graph showing another example of comparison of the measurement data in FIG. 13 when there is an abnormal point.

Furthermore, when the fundamental correlation shown in FIG. 15A fluctuates as shown in FIG. 16B, data shows that only one point indicates an abnormal value. In this case, one patch (the third-gradation patch out of the five gradations in FIG. 16B) has an image defect in the process from the secondary transfer process to the fixing process, so it is difficult to make automatic adjustment by the feedback control, and it is necessary to inform a user of the image defect or make a serviceman call to eliminate the cause of the image defect by hand.

If this image defect is detected by all three heads of the three-head type fixed-image detecting sensor 31 shown in FIGS. 4 and 5, it can be determined that there is a partial second transfer trouble or fixing trouble over the whole area in the main scanning corresponding direction. If data from only one head indicates an abnormality, there is a possibility of a spot transfer trouble, a fixing trouble due to wrinkles of a recording sheet, or the like.

In this manner, in the first image adjustment mode, the feedback control is made without using a recording sheet, so it is not possible to detect image variance due to the process after the secondary transfer. However, there are advantages that a recording sheet is not consumed and a time required for the adjustment is short. On the other hand, in the second image adjustment mode, a test pattern is formed on not only the intermediate transfer belt but also a recording sheet, there is a disadvantage that the recording sheet which is a user's belonging is consumed. However, an image that a user sees is an image output to the recording sheet, so in the second image adjustment mode in which the image on the recording sheet is detected and subject to the feedback control, the image quality can be maintained properly. Furthermore, it is possible to detect image variance due to the process after the secondary transfer, so the feedback control on the process after the secondary transfer can be made appropriately.

Consequently, in the image forming apparatus according to the present embodiment, the image adjustment in the second image adjustment mode is executed only when it can be determined that there is a possibility of image gradation in the process after the secondary transfer, and the normal regular image adjustment is made in the first image adjustment mode. Therefore, the image quality can be maintained properly with minimizing consumption of a recording sheet which is a user's belonging. That leads to improvement of user satisfaction and saving of a recording sheet.

As described above, the image forming apparatus according to the present embodiment includes the intermediate transfer belt (the sheet conveyance belt) which is an image carrier for carrying a toner image on the surface thereof, the image forming station which is an image forming unit for forming a toner image on the intermediate transfer belt, the secondary transfer roller which is a transfer unit for transferring the toner image on the intermediate transfer belt onto a recording sheet which is a recording medium, the fixing unit 25 which is a fixing unit for fixing the toner image on the recording sheet, and the intermediate-transfer-belt cleaning unit which is a cleaning unit for cleaning the surface of the intermediate transfer belt. Furthermore, the image forming apparatus according to the present embodiment has the toner-image detecting sensor which is a toner-image detecting unit for detecting the toner image on the intermediate transfer belt and the fixed-image detecting sensor which is a fixed-image detecting unit for detecting the toner image fixed on the recording sheet. The image forming apparatus according to the present embodiment has the first image adjustment mode and the second image adjustment mode. In the first image adjustment mode, an image adjustment test pattern is formed; the image adjustment test pattern formed on the intermediate transfer belt is detected by the toner-image detecting sensor; the image adjustment test pattern on the intermediate transfer belt is controlled to be conveyed to the intermediate-transfer-belt cleaning unit; and, the image forming conditions are adjusted on the basis of a detection value of the image adjustment test pattern detected by the toner-image detecting sensor. In the second image adjustment mode, an image adjustment test pattern is formed; the image adjustment test pattern formed on the intermediate transfer belt is detected by the toner-image detecting sensor; the image adjustment test pattern on the intermediate transfer belt is transferred and fixed on a recording sheet; the image adjustment test pattern fixed on the recording sheet is detected by the fixed-image detecting sensor; and, the image forming conditions are adjusted on the basis of a detection value of the image adjustment test pattern detected by the toner-image detecting sensor and a detection value of the image adjustment test pattern detected by the fixed-image detecting sensor.

In this manner, the image forming apparatus according to the present embodiment has the first image adjustment mode and the second image adjustment mode; the image forming apparatus regularly performs the image adjustment in the first image adjustment mode at predetermined intervals, and performs the image adjustment in the second image adjustment mode only if there is a possibility of a problem in the image forming process performed on the downstream side of the detection position of the toner-image detecting sensor in the toner-image moving direction (the secondary transfer process, the fixing process); and therefore, it is possible to minimize consumption of a recording sheet in the image adjustment control and maintain the good image quality for long periods.

Furthermore, in the image forming apparatus according to the present embodiment, the toner-image detecting unit and the fixed-image detecting unit are arranged so that the positions of them in the main scanning direction perpendicular to the recording-sheet conveying direction are aligned; therefore, the effect of uneven density of a detection result of the toner-image detecting sensor in the main scanning direction and the effect of uneven density of a detection result of the fixed-image detecting sensor in the main scanning direction can be about the same. Consequently, it is possible to prevent a relationship between the detection result of the toner-image detecting sensor and the detection result of the fixed-image detecting sensor from being affected by the effect of uneven density in the main scanning direction. As a result, a state of the secondary transfer process and the fixing process can be accurately detected on the basis of the detection result of the toner-image detecting sensor and the detection result of the fixed-image detecting sensor, and the image adjustment in the second image adjustment mode can be accurately made.

Furthermore, the image adjustment in the first image adjustment mode is made at predetermined intervals, and the image adjustment in the second image adjustment mode is made only when information correlating with image degradation in the secondary transfer process and the fixing process is obtained, and if it is determined that image degradation is caused in the secondary transfer process and the fixing process on the basis of the obtained information. Consequently, it is possible to prevent image degradation in the secondary transfer process and the fixing process properly with time while minimizing consumption of a recording sheet.

As the information correlating with the image degradation in the secondary transfer process and the fixing process, environmental information is obtained. If environmental conditions, especially the humidity, fluctuate, water content of the recording sheet is changed, so the influence on the secondary transfer process and the fixing process is great. Therefore, by using environmental information as the information correlating with image degradation in the secondary transfer process and the fixing process, the image degradation in the secondary transfer process and the fixing process can be suppressed.

Furthermore, by using the number of printed sheets as the information correlating with image degradation in the secondary transfer process and the fixing process, image degradation due to time degradation of the secondary transfer roller or the fixing roller can be prevented from occurring, and the image degradation in the secondary transfer process and the fixing process can be suppressed.

Furthermore, the image adjustment test pattern formed in the image adjustment in the first image adjustment mode and the image adjustment test pattern formed in the image adjustment in the second image adjustment mode are the same pattern, so a storage area for storing information on the image adjustment test pattern can be saved, and the number of nonvolatile memories can be reduced or a cheap low-capacity nonvolatile memory can be used, and also the apparatus can be produced cheaper.

Furthermore, the image adjustment test pattern formed in the image adjustment in the first image adjustment mode and the image adjustment test pattern formed in the image adjustment in the second image adjustment mode can be different patterns. The image adjustment test pattern formed in the image adjustment in the first image adjustment mode can be a pattern of multiple gradations required to accurately grasp developing characteristics without caring if it fits in a recording sheet, and therefore, in the first image adjustment mode, it is possible to grasp the developing characteristics more accurately. On the other hand, in the second image adjustment mode, unlike the first image adjustment mode, the image adjustment test pattern is formed so as to fit in a recording sheet, so that it is possible to suppress consumption of a recording sheet.

According to the present invention, the toner-image detecting unit and the fixed-image detecting unit are placed so that the positions of them in the main scanning corresponding direction are aligned; therefore, the effect of uneven density of a detection result of the toner-image detecting unit in the main scanning corresponding direction and the effect of uneven density of a detection result of the fixed-image detecting unit in the main scanning corresponding direction can be about the same. Consequently, it is possible to prevent a relationship between the detection result of the toner-image detecting unit and the detection result of the fixed-image detecting unit from being affected by the effect of uneven density in the main scanning direction. As a result, a state of the image forming process performed on the downstream side of the detection position of the toner-image detecting unit in the toner-image moving direction can be accurately detected on the basis of the detection result of the toner-image detecting unit and the detection result of the fixed-image detecting unit, and the highly-accurate image adjustment can be made.

Furthermore, the image forming apparatus according to the present invention includes the first image adjusting unit that performs the image adjustment control without transferring an image adjustment test pattern onto a recording medium, so the image adjustment control can be performed without consuming a recording medium. Therefore, the image forming apparatus regularly performs the first image adjustment control at predetermined intervals, and performs the second image adjustment control only if there is a possibility of a problem in the image forming process performed on the downstream side of the detection position of the toner-image detecting unit in the toner-image moving direction; and therefore, it is possible to minimize consumption of a recording medium in the image adjustment control and maintain the good image quality for long periods.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the image forming apparatus comprising:

a toner-image detecting unit that detects the toner image on the image carrier, the toner-image detecting unit including a plurality of toner-image detecting sensors aligned and mounted on a first sensor substrate in a main scanning direction;

a fixed-image detecting unit that detects the toner image fixed on the recording medium, the fixed-image detecting unit including a plurality of fixed-image detecting sensors aligned and mounted on a second sensor substrate in the main scanning direction;

a first image adjusting unit that performs a first operation including:

forming a first image adjustment test pattern on the image carrier, causing the toner-image detecting unit to detect the first image adjustment test pattern on the image carrier, controlling the first image adjustment test pattern on the image carrier not to be transferred onto the recording medium, and adjusting a first image forming condition based on a detection value of the first image adjustment test pattern detected by the toner-image detecting unit; and a second image adjusting unit that performs a second operation including:

forming a second image adjustment test pattern on the image carrier, and after the toner-image detecting unit detects the second image adjustment test pattern on the image carrier, transferring and fixing the second image adjustment test pattern on a recording medium, or forming a third image adjustment test pattern on the image carrier and transferring and fixing the third image adjustment test pattern formed on the image carrier on a recording medium, causing the fixed-image detecting unit to detect the second or third image adjustment test pattern fixed on the recording medium, and adjusting a second image forming condition based on a detection value of the second or third image adjustment test pattern detected by the toner-image detecting unit and a detection value of the second or third image adjustment test pattern detected by the fixed-image detecting unit, wherein the first sensor substrate of the toner-image detecting unit and the second sensor substrate of the fixed-image detecting unit are arranged so that a position of each of the toner-image detecting sensors in the main scanning direction perpendicular to a conveying direction of the recording medium is aligned with a position of each of the fixed-image detecting sensors, respectively, in the main scanning direction perpendicular to the conveying direction of the recording medium.

2. The image forming apparatus according to claim 1, wherein the first image adjustment test pattern formed by the first image adjusting unit and the second or third image adjustment test pattern formed by the second image adjusting unit are identical patterns.

3. The image forming apparatus according to claim 1, wherein the first image adjustment test pattern formed by the first image adjusting unit and the second or third image adjustment test pattern formed by the second image adjusting unit are different patterns.

4. The image forming apparatus according to claim 1, wherein the first image adjusting unit performs the first operation at predetermined intervals, and wherein the second image adjusting unit obtains information correlating with image degradation in an image forming process performed on a downstream side of a detection position of the toner-image detecting unit in a toner-image moving direction, and performs the second operation only if it is determined that the image degradation is caused in the image forming process performed on the downstream side of the detection position of the toner-image detecting unit in the toner-image moving direction based on the obtained information.

5. The image forming apparatus according to claim 4, wherein the information correlating with the image degradation in the image forming process performed on the downstream side of the detection position of the toner-image detecting unit in the toner-image moving direction is environmental information.

6. The image forming apparatus according to claim 4, wherein the information correlating with the image degradation in the image forming process performed on the downstream side of the detection position of the toner-image detecting unit in the toner-image moving direction is a number of printed sheets.

7. An image forming method in an image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the image forming method comprising:

detecting the toner image on the image carrier via a toner-image detecting unit including a plurality of toner-image detecting sensors aligned and mounted on a first sensor substrate in a main scanning direction;

detecting the toner image fixed on the recording medium via a fixed-image detecting unit including a plurality of fixed-image detecting sensors aligned and mounted on a second sensor substrate in the main scanning direction;

performing a first operation via a first image adjusting unit, the first operation including:

forming a first image adjustment test pattern on the image carrier, causing the toner-image detecting unit to detect the first image adjustment test pattern on the image carrier, controlling the first image adjustment test pattern on the image carrier not to be transferred onto the recording medium, and adjusting a first image forming condition based on a detection value of the first image adjustment test pattern detected by the toner-image detecting unit;

performing a second operation via a second image adjusting unit, the second operation including:

forming a second image adjustment test pattern on the image carrier, and after the toner-image detecting unit detects the second image adjustment test pattern on the image carrier, transferring and fixing the second image adjustment test pattern on a recording medium, or forming a third image adjustment test pattern on the image carrier and transferring and fixing the third image adjustment test pattern formed on the image carrier on a recording medium, causing the fixed-image detecting unit to detect the second or third image adjustment test pattern fixed on the recording medium, and adjusting a second image forming condition based on a detection value of the second or third image adjustment test pattern detected by the toner-image detecting unit and a detection value of the second or third image adjustment test pattern detected by the fixed-image detecting unit; and arranging the first sensor substrate of the toner-image detecting unit and the second sensor substrate of the fixed-image detecting unit so that a position of each of the toner-image detecting sensors in the main scanning direction perpendicular to a conveying direction of the recording medium is aligned with a position of each of the fixed-image detecting sensors, respectively, in the main scanning direction perpendicular to the conveying direction of the recording medium.

8. The image forming method according to claim 7, wherein the first image adjustment test pattern formed by the first image adjusting unit and the second or third image adjustment test pattern formed by the second image adjusting unit are identical patterns.

9. The image forming method according to claim 7, wherein the first image adjustment test pattern formed by the first image adjusting unit and the second or third image adjustment test pattern formed by the second image adjusting unit are different patterns.

10. The image forming method according to claim 7, wherein the first image adjusting unit performs the first operation at predetermined intervals, and wherein the second image adjusting unit obtains information correlating with image degradation in an image forming process performed on a downstream side of a detection position of the toner-image detecting unit in a toner-image moving direction, and performs the second operation only if it is determined that the image degradation is caused in the image forming process performed on the downstream side of the detection position of the toner-image detecting unit in the toner-image moving direction based on the obtained information.

11. The image forming method according to claim 10, wherein the information correlating with the image degradation in the image forming process performed on the downstream side of the detection position of the toner-image detecting unit in the toner-image moving direction is environmental information.

12. The image forming method according to claim 10, wherein the information correlating with the image degradation in the image forming process performed on the downstream side of the detection position of the toner-image detecting unit in the toner-image moving direction is a number of printed sheets.

13. A non-transitory computer-readable storage medium having computer-readable program instructions embodied in the medium for forming an image in an image forming apparatus that includes an image carrier for carrying a toner image on a surface thereof, an image forming unit for forming the toner image on the image carrier, a transfer unit for transferring the toner image on the image carrier onto a recording medium, and a fixing unit for fixing the toner image on the recording medium, the program instructions when executed causing a computer to execute steps comprising:

detecting the toner image on the image carrier via a toner-image detecting unit including a plurality of toner-image detecting sensors aligned and mounted on a first sensor substrate in a main scanning direction;

detecting the toner image fixed on the recording medium via a fixed-image detecting unit including a plurality of fixed-image detecting sensors aligned and mounted on a second sensor substrate in the main scanning direction;

performing a first operation via a first image adjusting unit, the first operation including:

forming a first image adjustment test pattern on the image carrier, causing the toner-image detecting unit to detect the first image adjustment test pattern on the image carrier, controlling the first image adjustment test pattern on the image carrier not to be transferred onto the recording medium, and adjusting a first image forming condition based on a detection value of the first image adjustment test pattern detected by the toner-image detecting unit; and performing a second operation via a second image adjusting unit, the second operation including:

forming a second image adjustment test pattern on the image carrier, and after the toner-image detecting unit detects the second image adjustment test pattern on the image carrier, transferring and fixing the second image adjustment test pattern on a recording medium, or forming a third image adjustment test pattern on the image carrier and transferring and fixing the third image adjustment test pattern formed on the image carrier on a recording medium, causing the fixed-image detecting unit to detect the second or third image adjustment test pattern fixed on the recording medium, and adjusting a second image forming condition based on a detection value of the second or third image adjustment test pattern detected by the toner-image detecting unit and a detection value of the second or third image adjustment test pattern detected by the fixed-image detecting unit, wherein the first sensor substrate of the toner-image detecting unit and the second sensor substrate of the fixed-image detecting unit are arranged so that a position of each of the toner-image detecting sensors in the main scanning direction perpendicular to a conveying direction of the recording medium is aligned with a position of each of the fixed-image detecting sensors, respectively, in the main scanning direction perpendicular to the conveying direction of the recording medium.

14. The computer-readable storage medium according to claim 13, wherein the first image adjustment test pattern formed by the first image adjusting unit and the second or third image adjustment test pattern formed by the second image adjusting unit are identical patterns.

15. The computer-readable storage medium according to claim 13, wherein the first image adjustment test pattern formed by the first image adjusting unit and the second or third image adjustment test pattern formed by the second image adjusting unit are different patterns.

16. The computer-readable storage medium according to claim 13, wherein the first image adjusting unit performs the first operation at predetermined intervals, and wherein the second image adjusting unit obtains information correlating with image degradation in an image forming process performed on a downstream side of a detection position of the toner-image detecting unit in a toner-image moving direction, and performs the second operation only if it is determined that the image degradation is caused in the image forming process performed on the downstream side of the detection position of the toner-image detecting unit in the toner-image moving direction based on the obtained information.

17. The computer-readable storage medium according to claim 16, wherein the information correlating with the image degradation in the image forming process performed on the downstream side of the detection position of the toner-image detecting unit in the toner-image moving direction is environmental information.

18. The computer-readable storage medium according to claim 16, wherein the information correlating with the image degradation in the image forming process performed on the downstream side of the detection position of the toner-image detecting unit in the toner-image moving direction is a number of printed sheets.

* * * * *